US008160484B2

(12) United States Patent
Hasegawa et al.

(10) Patent No.: US 8,160,484 B2
(45) Date of Patent: Apr. 17, 2012

(54) FIXING DEVICE AND IMAGE FORMING APPARATUS INCORPORATING SAME

(75) Inventors: Kenichi Hasegawa, Atsugi (JP); Akira Shinshi, Machida (JP); Hiroshi Yoshinaga, Ichikawa (JP); Yasunori Ishigaya, Yokohama (JP); Ryota Yamashina, Koganei (JP)

(73) Assignee: Ricoh Company, Ltd., Tokyo (JP)

( * ) Notice: Subject to any disclaimer, the term of this patent is extended or adjusted under 35 U.S.C. 154(b) by 368 days.

(21) Appl. No.: 12/588,295

(22) Filed: Oct. 9, 2009

(65) Prior Publication Data

US 2010/0092220 A1 Apr. 15, 2010

(30) Foreign Application Priority Data

Oct. 14, 2008 (JP) ..... 2008-264721

(51) Int. Cl.
*G03G 15/20* (2006.01)

(52) U.S. Cl. ..... 399/329

(58) Field of Classification Search ..... 399/328, 399/329

See application file for complete search history.

(56) References Cited

U.S. PATENT DOCUMENTS

| | | | | |
|---|---|---|---|---|
| 6,075,228 | A * | 6/2000 | Goto et al. | 219/216 |
| 8,032,069 | B2 * | 10/2011 | Shin et al. | 399/329 |
| 8,064,798 | B2 * | 11/2011 | Shinshi et al. | 399/122 |
| 2007/0292175 | A1 | 12/2007 | Shinshi | |
| 2008/0112739 | A1 | 5/2008 | Shinshi | |
| 2008/0175633 | A1 | 7/2008 | Shinshi | |
| 2008/0219730 | A1 | 9/2008 | Shinshi | |
| 2008/0253788 | A1 | 10/2008 | Shinshi | |
| 2008/0298862 | A1 | 12/2008 | Shinshi | |
| 2009/0067902 | A1 | 3/2009 | Yoshinaga et al. | |
| 2009/0123202 | A1 | 5/2009 | Yoshinaga et al. | |
| 2009/0148204 | A1 | 6/2009 | Yoshinaga et al. | |
| 2009/0245865 | A1 | 10/2009 | Shinshi et al. | |
| 2009/0311016 | A1 * | 12/2009 | Shinshi | 399/329 |
| 2011/0026987 | A1 * | 2/2011 | Hasegawa | 399/329 |

FOREIGN PATENT DOCUMENTS

| | | |
|---|---|---|
| JP | 2006-126536 | 5/2006 |
| JP | 2007-334205 | 12/2007 |
| JP | 2008-146010 | 6/2008 |
| JP | 2008-148582 | 7/2008 |
| JP | 2008-158482 | 7/2008 |
| JP | 2008-233900 | 10/2008 |

* cited by examiner

*Primary Examiner* — David Gray
*Assistant Examiner* — Gregory H Curran
(74) *Attorney, Agent, or Firm* — Harness, Dickey & Pierce, P.L.C.

(57) ABSTRACT

In a fixing device, a fixed member is fixedly provided inside a loop formed by a belt, and is pressed against a pressing rotary member via the belt to form a nip portion between the pressing rotary member and the belt to nip a recording medium bearing a toner image. A heating member is fixedly, provided inside the loop formed by the belt to heat the belt. The heating member includes an opening opposing the pressing rotary member. A seal member covers the opening in the heating member to prevent a foreign substance from entering the heating member through the opening in the heating member. A reinforcement member is fixedly provided inside the heating member and pressed against the fixed member via the seal member to reinforce the fixed member.

18 Claims, 7 Drawing Sheets

FIXING DEVICE AND IMAGE FORMING APPARATUS INCORPORATING SAME

PRIORITY STATEMENT

The present patent application claims priority from Japanese Patent Application No. 2008-264721, filed on Oct. 14, 2008, in the Japan Patent Office, which is hereby incorporated herein by reference in its entirety.

BACKGROUND OF THE INVENTION

1. Field of the Invention

Example embodiments generally relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium (e.g., a transfer sheet) according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Market demand for high-speed image forming apparatuses requires that a toner image be fixed on a recording medium properly in the fixing device even when the image forming apparatus forms the toner image on the recording medium at high speed with the shortened warm-up time period and first print time period.

To address such demand, the fixing device may include a heating member such as a heat-conductive metal pipe provided inside a loop formed by an endless belt and facing an inner circumferential surface of the belt. A heater heats the heating member so that the heating member heats the whole belt. A pressing rotary member located outside the loop formed by the belt is pressed against a fixed member fixedly provided inside the loop formed by the belt via the belt to form a nip portion between the pressing rotary member and the belt. The heating member includes an opening opposing the nip portion so that the heating member faces the inner circumferential surface of the belt at a position other than the nip portion, and is heated by the heater provided inside the heating member. With such a structure, a recording medium bearing a toner image passing through the nip portion receives heat from the belt heated by the heating member and pressure from the pressing rotary member to fix the toner image on the recording medium.

A clearance is provided between the fixed member and the heating member. Accordingly, even when the heating member has a thin thickness to improve heating efficiency, the heating member is not deformed by pressure applied to the fixed member by the pressing rotary member via the belt at the nip portion. However, when a lubricant is applied between the heating member and the belt to decrease resistance generated between the heating member and the belt sliding over the heating member, the lubricant may get into the heating member through the opening in the heating member opposing the nip portion. Consequently, a shortage of the lubricant may accelerate wear of the heating member and the belt, and the lubricant entering the heating member may adhere to the heater, resulting in degradation of the heater.

To address these problems, the heating member may have an endless loop shape corresponding to the belt without the opening. Instead of the fixed member, a reinforcement member may be provided inside the heating member and pressed against the pressing rotary member via the heating member and the belt to reinforce the heating member at the nip portion.

However, only the belt is provided between the heating member and the pressing rotary member, and therefore pressure from the pressing rotary member applies a substantial impact to the heating member. Accordingly, when the heating member has a thinner thickness to improve heating efficiency or when the pressing rotary member applies a greater pressure to the heating member via the belt to enlarge the nip portion so as to improve fixing efficiency, the heating member may be deformed. Consequently, a part of the belt may contact the heating member tightly, damaging the belt or generating noise. Further, deformation of the heating member may generate variation in the pressure applied to the heating member or may impact the heating member whenever the pressing rotary member contacts to and separates from the belt, neither of which is desirable.

SUMMARY

At least one embodiment may provide a fixing device that includes a flexible endless belt, a pressing rotary member, a fixed member, a heating member, a seal member, and a reinforcement member. The belt moves in a predetermined direction to heat and melt a toner image on a recording medium. The pressing rotary member opposes the belt. The fixed member is fixedly provided inside a loop formed by the belt and faces an inner circumferential surface of the belt. The fixed member is pressed against the pressing rotary member via the belt to form a nip portion between the pressing rotary member and the belt to nip the recording medium bearing the toner image as the recording medium bearing the toner image passes therethrough. The heating member is fixedly provided inside the loop formed by the belt and faces the inner circumferential surface of the belt to heat the belt. The heating member includes an opening opposing the pressing rotary member. The seal member covers the opening in the heating member to prevent a foreign substance from entering the heating member through the opening in the heating member. The reinforcement member is fixedly provided inside the heating member and pressed against the fixed member via the seal member to reinforce the fixed member.

At least one embodiment may provide an image forming apparatus that includes a fixing device for fixing a toner image on a recording medium. The fixing device includes a flexible endless belt, a pressing rotary member, a fixed member, a heating member, a seal member, and a reinforcement member. The belt moves in a predetermined direction to heat and melt the toner image on the recording medium. The pressing rotary member opposes the belt. The fixed member is fixedly provided inside a loop formed by the belt and faces an inner circumferential surface of the belt. The fixed member is pressed against the pressing rotary member via the belt to form a nip portion between the pressing rotary member and the belt to nip the recording medium bearing the toner image as the recording medium bearing the toner image passes therethrough. The heating member is fixedly provided inside the loop formed by the belt and faces the inner circumferential surface of the belt to heat the belt. The heating member includes an opening opposing the pressing rotary member. The seal member covers the opening in the heating member to prevent a foreign substance from entering the heating member through the opening in the heating member. The reinforcement member is fixedly provided inside the heating member and pressed against the fixed member via the seal member to reinforce the fixed member.

Additional features and advantages of example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
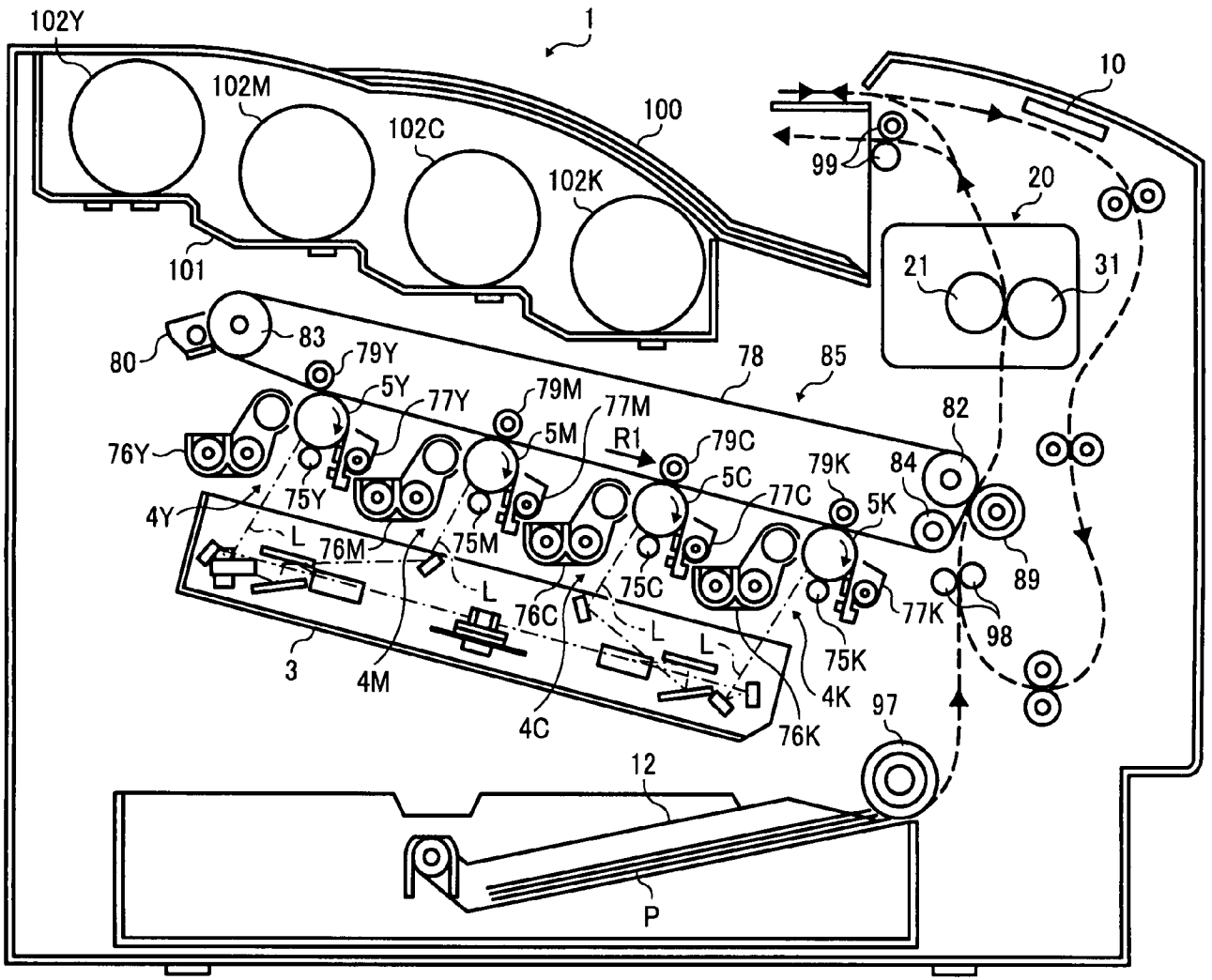
FIG. 1 is a schematic view of an image forming apparatus according to an example embodiment.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on", "against", "connected to", or "coupled to" another element or layer, then it can be directly on, against, connected or coupled to the other element or layer, or intervening elements or layers may be present. In contrast, if an element is referred to as being "directly on", "directly connected to", or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

The terminology used herein is for the purpose of describing particular embodiments only and is not intended to be limiting of the present invention. As used herein, the singular forms "a", "an", and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIG. 1, an image forming apparatus 1 according to an example embodiment is explained.

FIG. 1 is a schematic view of the image forming apparatus 1. As illustrated in FIG. 1, the image forming apparatus 1 includes an exposure device 3, image forming devices 4Y, 4M, 4C, and 4K, a controller 10, a paper tray 12, a fixing device 20, an intermediate transfer unit 85, a second transfer roller 89, a feed roller 97, a registration roller pair 98, an output roller pair 99, a stack portion 100, and/or a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and/or cleaners 77Y, 77M, 77C, and 77K, respectively.

The fixing device 20 includes a fixing belt 21 and/or a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and/or a tension roller 84.

The toner bottle holder 101 includes toner bottles 102Y, 102M, 102C, and 102K.

As illustrated in FIG. 1, the image forming apparatus 1 can be a copier, a facsimile machine, a printer, a multifunction printer having at least one of copying, printing, scanning, plotter, and facsimile functions, or the like. According to this example embodiment of the present invention, the image forming apparatus 1 functions as a tandem color printer for forming a color image on a recording medium.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones.

The intermediate transfer unit 85 is provided below the toner bottle holder 101. The image forming devices 4Y, 4M, 4C, and 4K are arranged to oppose the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a transfer process, and a cleaning process are performed on the photoconductive drums 5Y, 5M, 5C, and 5K to form yellow, magenta, cyan, and black toner images on the photoconductive drums 5Y, 5M, 5C, and 5K, respectively.

A driving motor drives and rotates the photoconductive drums 5Y, 5M, 5C, and 5K clockwise in FIG. 1. In the charging process, the chargers 75Y, 75M, 75C, and 75K uniformly charge surfaces of the photoconductive drums 5Y, 5M, 5C, and 5K at charging positions at which the chargers 75Y, 75M, 75C, and 75K oppose the photoconductive drums 5Y, 5M, 5C, and 5K, respectively.

In the exposure process, the exposure device 3 emits laser beams L onto the charged surfaces of the photoconductive drums 5Y, 5M, 5C, and 5K, respectively. In other words, the exposure device 3 scans and exposes the charged surfaces of the photoconductive drums 5Y, 5M, 5C, and 5K at irradiation positions at which the exposure device 3 opposes and irradiates the charged surfaces of the photoconductive drums 5Y, 5M, 5C, and 5K to form electrostatic latent images corresponding to yellow, magenta, cyan, and black colors, respectively.

In the development process, the development devices 76Y, 76M, 76C, and 76K make the electrostatic latent images formed on the surfaces of the photoconductive drums 5Y, 5M, 5C, and 5K visible as yellow, magenta, cyan, and black toner images at development positions at which the development devices 76Y, 76M, 76C, and 76K oppose the photoconductive drums 5Y, 5M, 5C, and 5K, respectively.

In the transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78 at first transfer positions at which the first transfer bias rollers 79Y, 79M, 79C, and 79K oppose the photoconductive drums 5Y, 5M, 5C, and 5K via the intermediate transfer belt 78, respectively. Thus, a color toner image is formed on the intermediate transfer belt 78. After the transfer of the yellow, magenta, cyan, and black toner images, a slight amount of residual toner, which has not been transferred onto the intermediate transfer belt 78, remains on the photoconductive drums 5Y, 5M, 5C, and 5K.

In the cleaning process, cleaning blades included in the cleaners 77Y, 77M, 77C, and 77K mechanically collect the residual toner from the photoconductive drums 5Y, 5M, 5C, and 5K at cleaning positions at which the cleaners 77Y, 77M, 77C, and 77K oppose the photoconductive drums 5Y, 5M, 5C, and 5K, respectively.

Finally, dischargers remove residual potential on the photoconductive drums 5Y, 5M, 5C, and 5K at discharging positions at which the dischargers oppose the photoconductive drums 5Y, 5M, 5C, and 5K, respectively. Thus, a series of image forming processes performed on the photoconductive drums 5Y, 5M, 5C, and 5K is finished.

The intermediate transfer belt 78 is supported by and looped over three rollers, which are the second transfer backup roller 82, the cleaning backup roller 83, and the tension roller 84. A single roller, that is, the second transfer backup roller 82, drives and endlessly moves (e.g., rotates) the intermediate transfer belt 78 in a direction R1.

The four first transfer bias rollers 79Y, 79M, 79C, and 79K and the photoconductive drums 5Y, 5M, 5C, and 5K sandwich the intermediate transfer belt 78 to form first transfer nip portions, respectively. The first transfer bias rollers 79Y, 79M, 79C, and 79K are applied with a transfer bias opposite to a polarity of toner forming the yellow, magenta, cyan, and black toner images on the photoconductive drums 5Y, 5M, 5C, and 5K, respectively. Accordingly, the yellow, magenta, cyan, and black toner images formed on the photoconductive drums 5Y, 5M, 5C, and 5K, respectively, are transferred and superimposed onto the intermediate transfer belt 78 rotating in the direction R1 successively at the first transfer nip portions formed between the photoconductive drums 5Y, 5M, 5C, and 5K and the intermediate transfer belt 78. Thus, the color toner image is formed on the intermediate transfer belt 78.

The paper tray 12 is provided in a lower portion of the image forming apparatus 1, and loads a plurality of transfer sheets P serving as recording media. The feed roller 97 rotates counterclockwise in FIG. 1 to feed an uppermost transfer sheet P of the plurality of transfer sheets P loaded on the paper tray 12 toward the registration roller pair 98.

The registration roller pair 98, which stops rotating temporarily, stops the uppermost transfer sheet P fed by the feed roller 97. For example, a roller nip portion formed between two rollers of the registration roller pair 98 contacts and stops a leading edge of the transfer sheet P. The registration roller pair 98 starts rotating to feed the transfer sheet P to a second transfer nip portion formed between the second transfer roller 89 and the intermediate transfer belt 78 at a time at which the color toner image formed on the intermediate transfer belt 78 reaches the second transfer nip portion.

At the second transfer nip portion, the second transfer roller 89 and the second transfer backup roller 82 sandwich the intermediate transfer belt 78. The second transfer roller 89 transfers the color toner image formed on the intermediate transfer belt 78 onto the transfer sheet P fed by the registration roller pair 98 at the second transfer nip portion formed between the second transfer roller 89 and the intermediate transfer belt 78. Thus, the desired color toner image is formed on the transfer sheet P. After the transfer of the color toner image, residual toner, which has not been transferred onto the transfer sheet P, remains on the intermediate transfer belt 78.

The intermediate transfer cleaner 80 collects the residual toner from the intermediate transfer belt 78 at a cleaning position at which the intermediate transfer cleaner 80 opposes the intermediate transfer belt 78.

Thus, a series of transfer processes performed on the intermediate transfer belt 78 is finished.

The transfer sheet P bearing the color toner image is sent to the fixing device 20. In the fixing device 20, the fixing belt 21 and the pressing roller 31 apply heat and pressure to the transfer sheet P to fix the color toner image on the transfer sheet P.

Thereafter, the fixing device 20 feeds the transfer sheet P bearing the fixed color toner image toward the output roller pair 99. The output roller pair 99 discharges the transfer sheet P to an outside of the image forming apparatus 1, that is, the stack portion 100. Thus, the transfer sheets P discharged by the output roller pair 99 are stacked on the stack portion 100 successively. Accordingly, a series of image forming processes performed by the image forming apparatus 1 is finished.

The controller 10 controls operations of the image forming apparatus 1.

Referring to FIGS. 2 to 7, the following describes a structure and operations of the fixing device 20.

Figure 2:
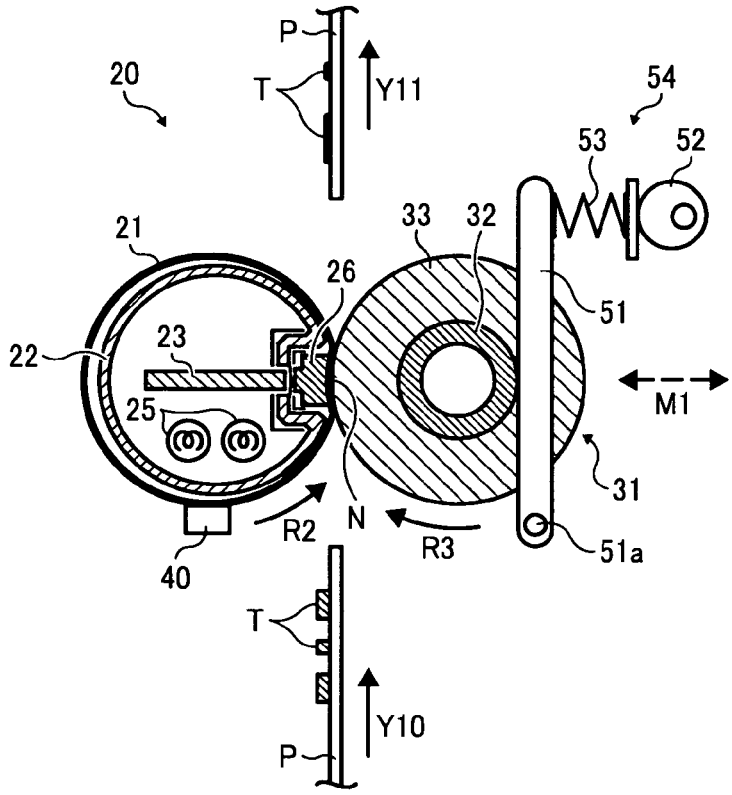
FIG. 2 is a schematic view (according to an example embodiment) of a fixing device included in the image forming apparatus shown in FIG. 1.

FIG. 2 is a schematic view of the fixing device 20. As illustrated in FIG. 2, the fixing device 20 further includes a heating member 22, a reinforcement member 23, a heater 25, a fixed member 26, a temperature sensor 40, and/or a contact-separate mechanism 54.

The contact-separate mechanism 54 includes a pressing lever 51, an eccentric cam 52, and/or a pressing spring 53. The pressing lever 51 includes a support shaft 51*a*.

The pressing roller 31 includes a core metal 32 and/or an elastic layer 33.

Figure 3:
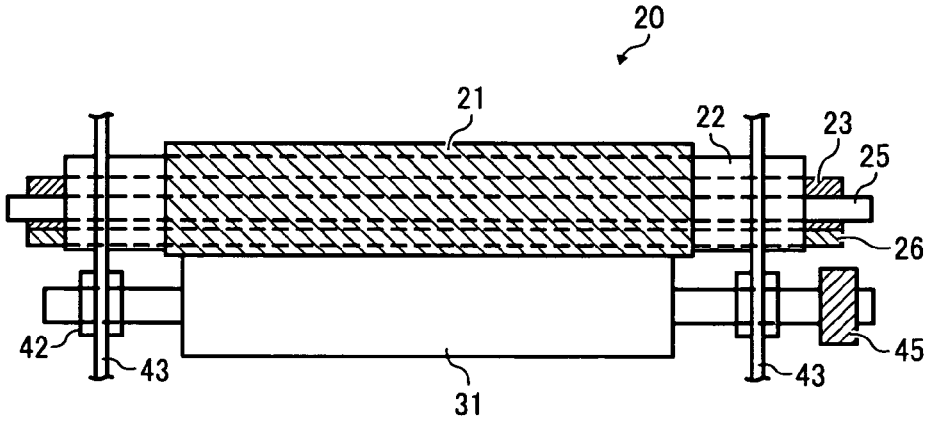
FIG. 3 is a side view (according to an example embodiment) of the fixing device shown in FIG. 2 in a width direction of the fixing device.

FIG. 3 is a side view of the fixing device 20 in a width direction of the fixing device 20. As illustrated in FIG. 3, the fixing device 20 further includes bearings 42, side plates 43, and/or a gear 45.

Figure 4:
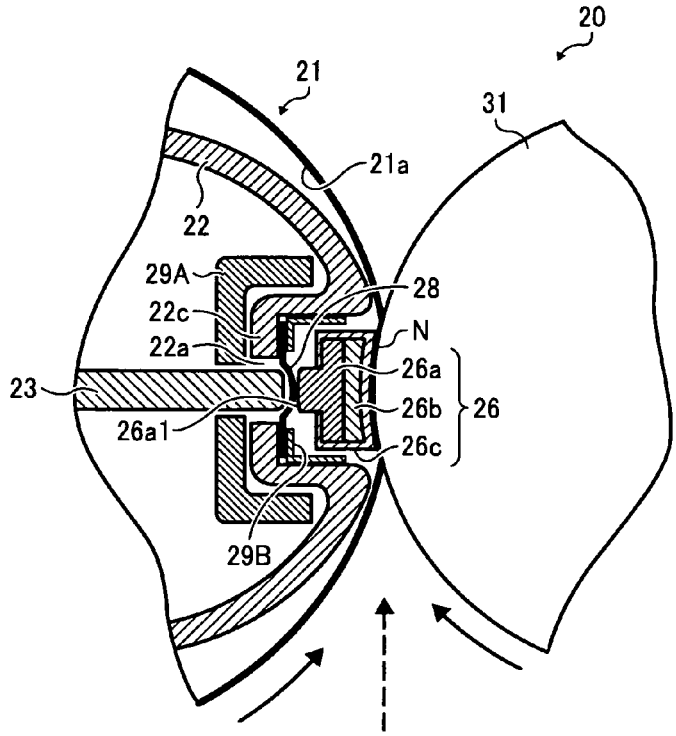
FIG. 4 is a partially enlarged view (according to an example embodiment) of the fixing device shown in FIG. 2.

FIG. 4 is a partially enlarged view of the fixing device 20. As illustrated in FIG. 4, the fixing device 20 further includes a seal member 28, a first stay 29A, and/or a second stay 29B. The fixing belt 21 includes an inner circumferential surface 21*a*. The heating member 22 includes an opening 22*a* and/or a concave portion 22*c*. The fixed member 26 includes a rigid portion 26*a*, an elastic portion 26*b*, and/or a lubricating sheet 26*c*. The rigid portion 26*a* includes a protrusion 26*a*1.

Figure 5A:
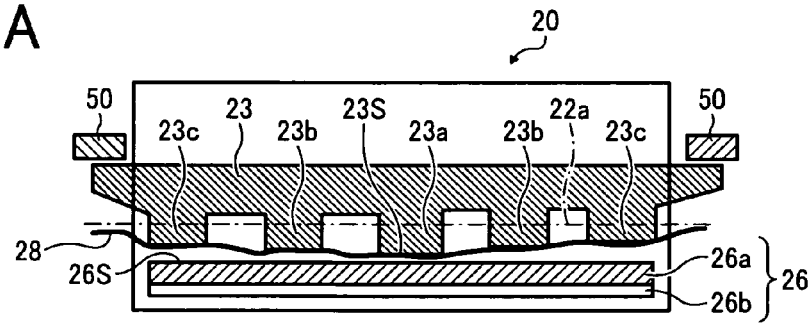
FIG. 5A is a side view (according to an example embodiment) of the fixing device shown in FIG. 3 when a pressing roller included in the fixing device does not apply pressure.
Figure 5B:
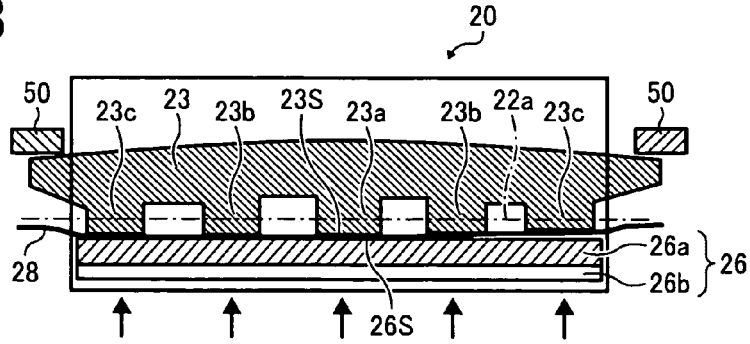
FIG. 5B is a side view (according to an example embodiment) of the fixing device shown in FIG. 3 when a pressing roller included in the fixing device applies pressure.

FIG. 5A is a side view of the fixing device 20 when the pressing roller 31 does not apply pressure. FIG. 5B is a side view of the fixing device 20 when the pressing roller 31 applies pressure. As illustrated in FIGS. 5A and 5B, the fixing device 20 further includes attachment portions 50. The reinforcement member 23 includes a first convex portion 23*a*, second convex portions 23*b*, third convex portions 23*c*, and/or a contact surface 23S. The fixed member 26 further includes a contact surface 26S.

Figure 6A:
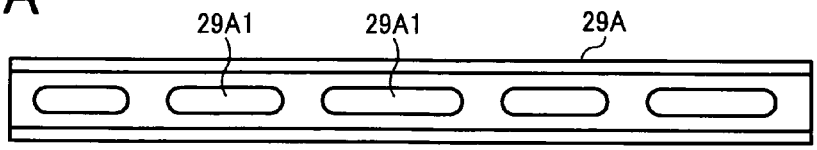
FIG. 6A is a plane view (according to an example embodiment) of an example of a first stay included in the fixing device shown in FIG. 4 seen in a leftward direction in FIG. 4.

FIG. 6A is a plane view of the first stay 29A. As illustrated in FIG. 6A, the first stay 29A includes through-holes 29A1.

Figure 6B:
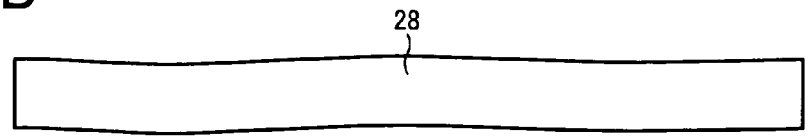
FIG. 6B is a plane view (according to an example embodiment) of an example of a seal member included in the fixing device shown in FIG. 4 seen in a leftward direction in FIG. 4.

FIG. 6B is a plane view of the seal member 28.

Figure 6C:
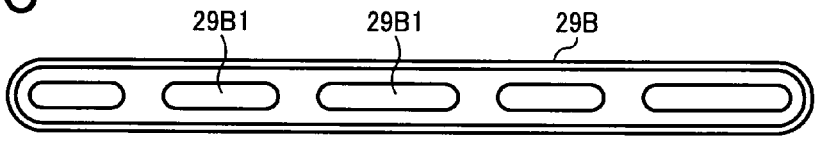
FIG. 6C is a plane view (according to an example embodiment) of an example of a second stay included in the fixing device shown in FIG. 4 seen in a leftward direction in FIG. 4.

FIG. 6C is a plane view of the second stay 29B. As illustrated in FIG. 6C, the second stay 29B includes through-holes 29B1.

As illustrated in FIG. 2, the fixing belt 21 serves as a thin endless belt which is flexible and bendable, and rotates or moves counterclockwise in FIG. 2 in a rotation direction R2. The fixing belt 21 includes a base layer, an elastic layer, and a releasing layer in such a manner that the base layer, the elastic layer, and the releasing layer are layered in this order from the inner circumferential surface 21*a* (depicted in FIG. 4) sliding over the fixed member 26 to an outer circumferential surface so that the fixing belt 21 has a thickness not greater than about 1.0 mm.

The base layer of the fixing belt 21 has a thickness in a range from about 30 μm to about 50 μm, and includes a metal material such as nickel and stainless steel and/or a resin material such as polyimide.

The elastic layer of the fixing belt 21 has a thickness in a range from about 100 μm to about 300 μm, and includes a rubber material such as silicon rubber, silicon rubber foam, and fluorocarbon rubber. The elastic layer prevents or reduces slight surface asperities of the fixing belt 21 generating at a nip portion N formed between the fixing belt 21 and the pressing roller 31. Accordingly, heat is uniformly transmitted from the fixing belt 21 to a toner image T on a transfer sheet P, suppressing formation of a rough image such as an orange peel image.

The releasing layer of the fixing belt 21 has a thickness in a range from about 10 μm to about 50 μm, and includes PFA (tetrafluoroethylene-perfluoroalkyl vinyl ether copolymer), PTFE (polytetrafluoroethylene), polyimide, polyetherimide, and/or PES (polyether sulfide). The releasing layer releases or separates a toner image T from the fixing belt 21.

The fixing belt 21 has a diameter in a range from about 15 mm to about 120 mm. According to this example embodiment, the fixing belt 21 has a diameter of about 30 mm.

As illustrated in FIGS. 2 and 4, the fixed member 26, the heater 25 serving as a heater or a heat source, the heating member 22, the reinforcement member 23 serving as a reinforcement member or a support member, the first stay 29A, the second stay 29B serving as a retainer, and the seal member 28 are fixedly provided inside a loop formed by the fixing belt 21 serving as a belt. In other words, the fixed member 26, the heater 25, the heating member 22, the reinforcement member 23, the first stay 29A, the second stay 29B, and the seal member 28 do not face an outer circumferential surface of the fixing belt 21, but face the inner circumferential surface 21*a* of the fixing belt 21.

The fixed member 26 is fixedly provided inside the loop formed by the fixing belt 21 in such a manner that the inner circumferential surface 21*a* of the fixing belt 21 slidably contacts the fixed member 26. The fixed member 26 is pressed against the pressing roller 31 via the fixing belt 21 to form the nip portion N between the pressing roller 31 and the fixing belt 21 to nip and feed a transfer sheet P. As illustrated in FIG. 3, both ends of the fixed member 26 in a width direction of the fixed member 26, that is, in an axial direction of the fixing belt 21 are fixedly mounted on the side plates 43 of the fixing device 20, respectively, in such a manner that the side plates 43 support the fixed member 26.

As illustrated in FIGS. 2 and 4, the heating member 22 includes a pipe member having a thickness not greater than about 0.2 mm. According to this example embodiment, the heating member 22 has a thickness of about 0.1 mm. The heating member 22 directly faces the inner circumferential surface 21*a* of the fixing belt 21 at a portion of the fixing belt 21 other than the nip portion N. At the nip portion N, the heating member 22 has a concave shape to form the concave portion 22*c* encompassing the opening 22*a*. The fixed member 26 is inserted into the concave portion 22*c* of the heating member 22 in such a manner that a clearance is provided between the fixed member 26 and the heating member 22. As illustrated in FIG. 3, both ends of the heating member 22 in a width direction of the heating member 22, that is, in the axial direction of the fixing belt 21 are fixedly mounted on the side plates 43 of the fixing device 20, respectively, in such a manner that the side plates 43 support the heating member 22.

Radiation heat (e.g., radiation light) generated by the heater 25 heats the heating member 22 so that the heating member 22 heats the fixing belt 21. In other words, the heater 25 directly heats the heating member 22, and indirectly heats the fixing belt 21 via the heating member 22. The heating member 22 may include a metallic heat conductor, that is, a metal having heat conductivity, such as aluminum, iron, and stainless steel. When the heating member 22 has a thickness not greater than about 0.2 mm, the heating member 22 provides an improved heating efficiency for heating the heating member 22 and the fixing belt 21. According to this example embodiment, the heating member 22 includes stainless steel and has a thickness of about 0.1 mm.

The heater 25, serving as a heater or a heat source, includes a halogen heater and/or a carbon heater. As illustrated in FIG. 3, both ends of the heater 25 in a width direction of the heater 25, that is, in the axial direction of the fixing belt 21 are fixedly mounted on the side plates 43 of the fixing device 20. Radiation heat generated by the heater 25, which is controlled by a power source provided in the image forming apparatus 1 depicted in FIG. 1, heats the heating member 22. The heating member 22 heats a substantially whole portion of the fixing belt 21. In other words, the heating member 22 heats a portion of the fixing belt 21 other than the nip portion N. Heat is transmitted from the heated outer circumferential surface of the fixing belt 21 to the toner image T on the transfer sheet P.

As illustrated in FIG. 2, the temperature sensor 40, such as a thermistor, opposes the outer circumferential surface of the fixing belt 21 to detect temperature of the outer circumferential surface of the fixing belt 21. The controller 10 depicted in FIG. 1 controls the heater 25 according to a detection result provided by the temperature sensor 40 so as to adjust the temperature (e.g., a fixing temperature) of the fixing belt 21 to a desired temperature.

As described above, in the fixing device 20 according to this example embodiment, the heating member 22 does not heat a part of the fixing belt 21 but heats a substantially whole portion of the fixing belt 21 in a circumferential direction of the fixing belt 21. Accordingly, even when the image forming apparatus 1 depicted in FIG. 1 forms a toner image at a high speed, the fixing belt 21 is heated sufficiently to suppress fixing failure. In other words, the relatively simple structure of the fixing device 20 heats the fixing belt 21 efficiently, resulting in a shortened warm-up time period, a shortened first print time period, and the compact image forming apparatus 1.

A gap δ formed between the fixing belt 21 and the heating member 22 at a position other than the nip portion N may have a size greater than 0 mm and not greater than 1 mm, which is shown as $0\ \text{mm} \leqq \delta \leqq 1\ \text{mm}$. Accordingly, the fixing belt 21 does not slidably contact the heating member 22 at an increased area, suppressing wear of the fixing belt 21. Further, a substantial clearance is not provided between the heating member 22 and the fixing belt 21, suppressing decrease in heating efficiency for heating the fixing belt 21. Moreover, the heating member 22 disposed close to the fixing belt 21 maintains a circular loop formed by the flexible fixing belt 21, decreasing degradation and damage of the fixing belt 21 due to deformation of the fixing belt 21.

A lubricant (e.g., fluorine grease) is applied between the fixing belt 21 and the heating member 22 to decrease wear of the fixing belt 21 even when the fixing belt 21 slidably contacts the heating member 22. In order to decrease resistance generated between the heating member 22 and the fixing belt 21 sliding over the heating member 22, a slide surface of the heating member 22 may include a material having a low friction coefficient. Alternatively, a surface layer including fluorine may be provided on the inner circumferential surface 21*a* of the fixing belt 21.

According to this example embodiment, the heating member 22 has a substantially circular shape in cross-section. Alternatively, the heating member 22 may have a polygonal shape in cross-section.

The reinforcement member 23, serving as a support member or a reinforcement member, supports and reinforces the fixed member 26 which forms the nip portion N between the fixing belt 21 and the pressing roller 31. The reinforcement member 23 is fixedly provided inside the loop formed by the fixing belt 21 and faces the inner circumferential surface 21*a* of the fixing belt 21. As illustrated in FIG. 3, width of the reinforcement member 23 in a width direction of the reinforcement member 23, that is, in the axial direction of the fixing belt 21 is equivalent to width of the fixed member 26 in the width direction of the fixed member 26, that is, in the axial direction of the fixing belt 21. Both ends of the reinforcement member 23 in the width direction of the reinforcement member 23, that is, in the axial direction of the fixing belt 21 are fixedly mounted on the side plates 43 of the fixing device 20 in such a manner that the side plates 43 support the reinforcement member 23. The reinforcement member 23 is pressed against the pressing roller 31 serving as a pressing rotary member via the seal member 28, the fixed member 26, and the fixing belt 21. Thus, the fixed member 26 may not be deformed substantially when the fixed member 26 receives pressure applied by the pressing roller 31 at the nip portion N.

In order to provide the above-described functions, the reinforcement member 23 may include a metal material, such as stainless steel and iron, providing a high mechanical strength. An opposing surface of the reinforcement member 23 opposing the heater 25 may include a heat insulation material partially or wholly. Alternatively, the opposing surface of the reinforcement member 23 opposing the heater 25 may be bright-annealed or mirror-ground. Accordingly, heat output by the heater 25 toward the reinforcement member 23 to heat the reinforcement member 23 is used to heat the heating member 22, improving heating efficiency for heating the heating member 22 and the fixing belt 21.

As illustrated in FIG. 2, the pressing roller 31, serving as a pressing rotary member, opposes and contacts the outer circumferential surface of the fixing belt 21 at the nip portion N, and has a diameter of about 30 mm. In the pressing roller 31, the elastic layer 33 is formed on the hollow core metal 32. The elastic layer 33 includes silicon rubber foam, silicon rubber, and/or fluorocarbon rubber. A thin releasing layer including PFA and/or PTFE may be formed on the elastic layer 33 to serve as a surface layer. The pressing roller 31 is pressed against the fixing belt 21 to form the desired nip portion N between the pressing roller 31 and the fixing belt 21.

As illustrated in FIG. 3, the gear 45 engaging a driving gear of a driving mechanism is mounted on the pressing roller 31 to rotate the pressing roller 31 clockwise in FIG. 2 in a rotation direction R3. Both ends of the pressing roller 31 in a width direction of the pressing roller 31, that is, in an axial direction of the pressing roller 31 are rotatably supported by the side plates 43 of the fixing device 20 via the bearings 42, respectively. A heat source, such as a halogen heater, may be provided inside the pressing roller 31.

When the elastic layer 33 of the pressing roller 31 includes a sponge material such as silicon rubber foam, the pressing roller 31 applies a decreased pressure to the nip portion N to decrease bending of the fixed member 26. Further, the pressing roller 31 provides increased heat insulation, and therefore heat is not transmitted from the fixing belt 21 to the pressing roller 31 easily, improving heating efficiency for heating the fixing belt 21.

According to this example embodiment, the diameter of the fixing belt 21 is equivalent to the diameter of the pressing roller 31. Alternatively, the diameter of the fixing belt 21 may be smaller than the diameter of the pressing roller 31. In this case, a curvature of the fixing belt 21 is smaller than a curvature of the pressing roller 31 at the nip portion N, and therefore a transfer sheet P separates from the fixing belt 21 easily when the transfer sheet P is fed out of the nip portion N.

Yet alternatively, the diameter of the fixing belt 21 may be greater than the diameter of the pressing roller 31. In this case, the pressing roller 31 does not apply pressure to the heating member 22 regardless of a relation between the diameter of the fixing belt 21 and the diameter of the pressing roller 31.

As illustrated in FIG. 2, the contact-separate mechanism 54 moves the pressing roller 31 with respect to the fixing belt 21 so that the pressing roller 31 contacts to and separates from the fixing belt 21. In the contact-separate mechanism 54, the pressing lever 51 is rotatably supported by the side plate 43 (depicted in FIG. 3) of the fixing device 20 via the support shaft 51*a* provided at one end of the pressing lever 51 in a longitudinal direction of the pressing lever 51 (e.g., a direction perpendicular to the axial direction of the pressing roller 31), in such a manner that the pressing lever 51 rotates about the support shaft 51*a*. A center portion of the pressing lever 51 in the longitudinal direction of the pressing lever 51 contacts the bearing 42 (depicted in FIG. 3) of the pressing roller 31, which is movably held in an elongate hole provided in the side plate 43. The pressing spring 53 is connected to another end of the pressing lever 51 in the longitudinal direction of the pressing lever 51. The eccentric cam 52 engages a hold plate for holding the pressing spring 53. A driving motor rotates the eccentric cam 52.

When the eccentric cam 52 rotates, the pressing lever 51 rotates about the support shaft 51*a* so that the pressing roller 31 moves in a moving direction M1 shown in a broken line in FIG. 2. For example, when the fixing device 20 fixes a toner image T on a transfer sheet P, the eccentric cam 52 is positioned at a pressing position as illustrated in FIG. 2 to press the pressing roller 31 against the fixing belt 21 to form the desired nip portion N. By contrast, when the fixing device 20 does not fix the toner image T on the transfer sheet P in a standby mode or when the transfer sheet P is jammed, the eccentric cam 52 rotates 20, by 180 degrees from the pressing position to separate the pressing roller 31 from the fixing belt 21 or to cause the pressing roller 31 to apply decreased pressure to the fixing belt 21.

Referring to FIG. 2, the following describes normal operations of the fixing device 20 having the above-described structure.

When the image forming apparatus 1 depicted in FIG. 1 is powered on, power is supplied to the heater 25, and the pressing roller 31 starts rotating in the rotation direction R3. Accordingly, friction between the pressing roller 31 and the fixing belt 21 rotates the fixing belt 21 in the rotation direction R2. In other words, the fixing belt 21 is driven by the rotating pressing roller 31.

Thereafter, a transfer sheet P is sent from the paper tray 12 (depicted in FIG. 1) toward the second transfer roller 89 (depicted in FIG. 1) so that a color toner image (e.g., a toner image T) is transferred from the intermediate transfer belt 78 (depicted in FIG. 1) onto the transfer sheet P. A guide guides the transfer sheet P bearing the toner image T in a direction Y10 so that the transfer sheet P bearing the toner image T enters the nip portion N formed between the fixing belt 21 and the pressing roller 31 pressed against the fixing belt 21.

The fixing belt 21 heated by the heater 25 via the heating member 22 applies heat to the transfer sheet P bearing the toner image T. Simultaneously, the fixed member 26 reinforced by the reinforcement member 23 and the pressing roller 31 apply pressure to the transfer sheet P bearing the toner image T. Thus, the heat and the pressure fix the toner image T on the transfer sheet P.

Thereafter, the transfer sheet P bearing the fixed toner image T is sent out of the nip portion N and conveyed in a direction Y11.

Referring to FIG. 4, the following describes detailed structure and operations of the fixing device 20 according to this example embodiment. FIG. 4 illustrates the elements of the fixing device 20 provided near the nip portion N.

The opening 22*a* is provided in the heating member 22 at a position opposing the pressing roller 31. The seal member 28 having a sheet shape covers the opening 22*a* in the heating member 22 to prevent a foreign substance from entering the heating member 22 through the opening 22*a* in the heating member 22. For example, when the lubricant serving as a foreign substance applied between the heating member 22 and the fixing belt 21 enters the heating member 22, shortage of the lubricant may increase resistance generated between the heating member 22 and the fixing belt 21 sliding over the heating member 22 to accelerate wear or degradation of the heating member 22 and the fixing belt 21. Further, the lubricant entering the heating member 22 may be adhered to the heater 25 depicted in FIG. 2 to degrade the heater 25 or vaporize the lubricant. According to this example embodiment, fluorine grease providing high penetration is used as the lubricant. Therefore, the seal member 28 can effectively prevent the lubricant from entering the heating member 22 through the opening 22*a* in the heating member 22.

The reinforcement member 23 fixedly provided inside the heating member 22 in such a manner that the reinforcement member 23 faces an inner circumferential surface of the heating member 22 opposes the fixed member 26 via the seal, member 28. In other words, the reinforcement member 23 reinforces and supports the fixed member 26 serving as a fixed member or a nip portion formation member for forming the nip portion N. For example, the seal member 28 may be a deformable thin film member or a deformable thin sheet member including at least one of silicon rubber, fluorocarbon rubber, and fluorocarbon resin and having a thickness in a range from about 0.1 mm to about 0.5 mm. According to this example embodiment, the seal member 28 includes silicon rubber. A head of the reinforcement member 23 protruding from the opening 22*a* of the heating member 22 deforms the seal member 28 and is pressed against the fixed member 26 via the seal member 28.

With the above-described structure, the pressing roller 31 does not apply pressure to the heating member 22. Accordingly, even when the heating member 22 has a decreased thickness or the pressing roller 31 applies increased pressure to the fixing belt 21, the heating member 22 may not be deformed. Moreover, even when the pressing roller 31 contacts to and separates from the fixing belt 21, the heating member 22 may not be deformed.

Even when the reinforcement member 23 is deformed by pressure applied by the pressing roller 31 and the fixed member 26 moves leftward in FIG. 4, the clearance provided between the fixed member 26 and the concave portion 22*c* of the heating member 22 prevents the fixed member 26 from pressing against the concave portion 22*c* of the heating member 22.

The second stay 29B, serving as a retainer, is positioned at edges (e.g., a circumference) of the opening 22*a* in the heating member 22 in such a manner that the second stay 29B and the heating member 22 sandwich the seal member 28. The second stay 29B may be a stainless steel plate having a thickness of about 0.5 mm having a box shape as illustrated in FIG. 6C, and is press-fitted into the concave portion 22*c* of the heating member 22 in such a manner, that the second stay 29B and the concave portion 22*c* of the heating member 22 sandwich the seal member 28. Accordingly, margins of the seal member 28 contact the heating member 22 tightly to prevent or reduce the lubricant entering the heating member 22. When a heat-resistant sealing agent is applied to a press-fitted surface of the second stay 29B, the seal member 28 provides an improved sealing property.

The seal member 28 is provided on an outer circumferential surface of the concave portion 22*c* of the heating member 22 opposite an inner circumferential surface of the concave portion 22*c* of the heating member 22 opposing the heater 25 depicted in FIG. 2. Accordingly, the heater 25 does not directly heat the seal member 28 to decrease thermal degradation of the seal member 28.

The seal member 28 (e.g., a sheet member) provides change in thickness which can be ignored and may not affect pressure applied between the reinforcement member 23 and the fixed member 26. Even when a pressing portion at which the fixed member 26 is pressed against the reinforcement member 23 moves, the seal member 28 is stretched to prevent the heating member 22 from being pulled and deformed. An amount of deformation of the seal member 28 may be not greater than about 1.0 mm.

The seal member 28 provides a high oil-sealing property, a small change in thickness due to compression, a high stretch property (e.g., a small amount of stretch being allowable), and a high heat resistance. The seal member 28 may have a thickness not greater than about 1.0 mm (e.g., not greater than about 0.5 mm preferably) and may include silicon rubber, fluorocarbon rubber, and/or fluorocarbon resin.

The first stay 29A may be a stainless steel plate having a U-like shape and a thickness of about 1.5 mm. The first stay 29A engages and covers the inner circumferential surface of the concave portion 22*c* of the heating member 22 to form the concave portion 22*c* precisely. In order to improve heating efficiency for heating the heating member 22, an opposing surface of the first stay 29A opposing the heater 25 may be bright-annealed or mirror-ground.

As illustrated in FIG. 4, in the fixed member 26, the rigid portion 26*a* includes a metal material. The elastic portion 26*b* includes a rubber material. The lubricating sheet 26*c* covers the rigid portion 26*a* and the elastic portion 26*b*. The protrusion 26*a*1 of the rigid portion 26*a* protrudes and is pressed against the reinforcement member 23 via the seal member 28. The rigid portion 26*a* includes a rigid material such as high-rigid metal and/or ceramic so that the rigid portion 26*a* may not be bent substantially even when the rigid portion 26*a* receives pressure from the pressing roller 31. An outer circumferential surface of the elastic portion 26*b* or the rigid portion 26*a* opposing the pressing roller 31 has a concave shape corresponding to the curvature of the pressing roller 31. Accordingly, a transfer sheet P bearing a fixed toner image T is sent out of the nip portion N to correspond to the curvature of the pressing roller 31. Consequently, the transfer sheet P bearing the fixed toner image T may not be attracted to the fixing belt 21 and may separate from the fixing belt 21.

According to this example embodiment, the fixed member 26 for forming the nip portion N has the concave shape. Alternatively, the fixed member 26 may have a planar shape. For example, a slide surface of the fixed member 26, that is, an outer surface of the fixed member 26 opposing the pressing roller 31 may have a planer shape. Accordingly, the nip portion N is substantially parallel to a surface of a transfer sheet P bearing a toner image T. In other words, the fixing belt 21 contacts the transfer sheet P tightly to improve fixing property. Further, an increased curvature of the fixing belt 21 at an exit of the nip portion N separates the transfer sheet P sent out of the nip portion N from the fixing belt 21 easily.

FIG. 5A illustrates deformation of the reinforcement member 23 when the pressing roller 31 depicted in FIG. 4 is separated from the fixing belt 21 depicted in FIG. 4. FIG. 5B illustrates deformation of the reinforcement member 23 when the pressing roller 31 pressingly contacts the fixing belt 21. In other words, FIGS. 5A and 5B illustrate a slide-contact portion of the fixed member 26 over which the fixing belt 21 slides.

As illustrated in FIGS. 5A and 5B, the reinforcement member 23 is divided into a plurality of convex portions, which are the first convex portion 23*a*, the second convex portions 23*b*, and the third convex portions 23*c*, in the width direction of the reinforcement member 23, that is, in the axial direction of the fixing belt 21. Accordingly, the reinforcement member 23 is not pressed against the fixed member 26 in the whole width of the reinforcement member 23. However, the reinforcement member 23 is pressed against the rigid portion 26*a* of the fixed member 26. Therefore, the reinforcement member 23 applies pressure to the fixed member 26 uniformly in the width direction of the reinforcement member 23. Accordingly, pressure is applied to the nip portion N uniformly in the width direction of the reinforcement member 23. The elastic portion 26*b* of the fixed member 26 is provided on the rigid portion 26*a* of the fixed member 26 in such a manner that the elastic portion 26*b* is disposed closer to the nip portion N than the rigid portion 26*a* is. Thus, the elastic portion 26*b* of the fixed member 26 corresponds to a slightly rough surface of a toner image T on a transfer sheet P passing through the nip portion N. Consequently, the fixing device 20 can fix the toner image T on the transfer sheet P properly.

As illustrated in FIG. 4, an outer circumferential surface of the lubricating sheet 26*c* is impregnated with the lubricant such as fluorine grease to decrease resistance generated between the fixed member 26 and the fixing belt 21 sliding over the fixed member 26.

The fixed member 26 is mounted loosely inside the second stay 29B having the box shape as illustrated in FIG. 6C. The box shape of the second stay 29B regulates movement of the fixed member 26 in leftward and rightward directions in FIG. 4 and a direction perpendicular to the leftward and rightward directions.

As illustrated in FIGS. 5A and 5B, the reinforcement member 23 includes a stainless steel plate. Both ends of the reinforcement member 23 in the width direction of the reinforcement member 23, that is, in the axial direction of the fixing belt 21 are fixedly attached to the attachment portions 50 provided in the side plates 43 (depicted in FIG. 3) of the fixing device 20, respectively.

The reinforcement member 23 includes the contact surface 23S for contacting the seal member 28 and opposing the fixed member 26 via the seal member 28. When no load is applied to the reinforcement member 23, that is, when no pressure is applied to the reinforcement member 23, a center portion of the contact surface 23S of the reinforcement member 23 in the width direction of the reinforcement member 23 protrudes toward a counterpart member, that is, the fixed member 26 than both end portions of the contact surface 23S of the reinforcement member 23 in the width direction of the reinforcement member 23.

For example, the five convex portions, which are the first convex portion 23*a*, the second convex portions 23*b*, and the third convex portions 23*c*, of the reinforcement member 23 correspond to the five through-holes 29A1 provided in the first stay 29A depicted in FIG. 6A and the five through-holes 29B1 provided in the second stay 29B depicted in FIG. 6C, respectively. The first convex portion 23*a*, the second convex portions 23*b*, and the third convex portions 23*c* of the reinforcement member 23 are smaller than the corresponding through-holes 29A1 and 29B1, respectively, to penetrate the through-holes 29A1 and 29B1 while contacting the seal member 28 so as to press against the fixed member 26. Namely, the reinforcement member 23 does not contact the first stay 29A and the second stay 29B.

When no load is applied to the reinforcement member 23 as illustrated in FIG. 5A, that is, when no pressure is applied by the pressing roller 31 depicted in FIG. 4, an amount of protrusion for protruding toward the fixed member 26 varies among the first convex portion 23*a*, the second convex portions 23*b*, and the third convex portions 23*c*. For example, the amount of protrusion of the second convex portions 23*b* adjacent to the first convex portion 23*a* is smaller than the amount of protrusion of the center first convex portion 23*a*, and the amount of protrusion of the third convex portions 23*c* provided at both ends of the reinforcement member 23 in the width direction of the reinforcement member 23 is smaller than the amount of protrusion of the second convex portions 23*b*. In other words, a virtual ridge line of the contact surface 23S for contacting the seal member 28 formed by the first convex portion 23*a*, the second convex portions 23*b*, and the third convex portions 23*c* of the reinforcement member 23 has a convex shape protruding toward the fixed member 26. Accordingly, when pressure is applied by the pressing roller 31 (depicted in FIG. 4) as illustrated in FIG. 5B, that is, when pressure is applied to a transfer sheet P to fix a toner image T on the transfer sheet P, the contact surface 23S formed by the first convex portion 23*a*, the second convex portions 23*b*, and the third convex portions 23*c* of the reinforcement member 23 is flattened by the pressure applied by the pressing roller 31 in the width direction of the reinforcement member 23. Accordingly, the nip portion N formed by the fixed member 26 is flattened in the width direction of the fixed member 26, that is, in the axial direction of the fixing belt 21. In FIGS. 5A and 5B, alternate long and short dashed lines indicate a position of the opening 22*a* (depicted in FIG. 4) of the heating member 22.

Referring to FIG. 3, the following describes the above-described effects provided by the fixing device 20 in detail.

Both end portions of the reinforcement member 23 in the width direction of the reinforcement member 23 are fixedly supported by the side plates 43, respectively. Accordingly, when the reinforcement member 23 receives pressure applied by the pressing roller 31, the reinforcement member 23 is bent, and therefore pressure applied by a center portion of the reinforcement member 23 in the width direction of the reinforcement member 23 to the fixed member 26 is smaller than pressure applied by both end portions of the reinforcement member 23 in the width direction of the reinforcement member 23 to the fixed member 26. Consequently, a nip length of a center portion of the nip portion N in the width direction of the fixed member 26 differs from a nip length of both end portions of the nip portion N in the width direction of the fixed member 26, decreasing conveying performance of conveying a transfer sheet P and moving performance of the fixing belt 21.

To address this, according to this example embodiment as illustrated in FIG. 5A, the contact surface 23S of the reinforcement member 23 for contacting the seal member 28 and opposing the fixed member 26 via the seal member 28 has the convex shape so that the contact surface 23S of the reinforcement member 23 is flattened when pressure is applied by the pressing roller 31 as illustrated in FIG. 5B even when the reinforcement member 23 is bent in the width direction of the reinforcement member 23. Accordingly, difference between the nip length of the center portion of the nip portion N in the width direction of the fixed member 26 and the nip length of both end portions of the nip portion N in the width direction of the fixed member 26 becomes smaller.

As illustrated in FIG. 5B, when pressure is applied by the pressing roller 31, both end portions of the reinforcement member 23 in the width direction of the reinforcement member 23 are hardly bent. By contrast, the center portion of the reinforcement member 23 in the width direction of the reinforcement member 23 is bent and therefore a center portion of the fixed member 26 in the width direction of the fixed member 26 moves upward in FIG. 5B. In other words, the fixed member 26 moves closer to the concave portion 22*c* of the heating member 22 provided with the opening 22*a* depicted in FIG. 4. However, the clearance provided between the fixed member 26 and the concave portion 22*c* of the heating member 22 prevents the fixed member 26 from contacting the heating member 22. Thus, the heating member 22 may not be deformed.

For example, pressure applied by the pressing roller 31 bends the fixed member 26 and the reinforcement member 23 so that the center portions of the fixed member 26 and the reinforcement member 23 in the width direction of the fixed member 26 and the reinforcement member 23 move upward in FIG. 5B by about 0.7 mm. By contrast, both end portions of the fixed member 26 and the reinforcement member 23 in the width direction of the fixed member 26 and the reinforcement member 23 are hardly bent and therefore hardly move. Accordingly, the contact surface 26S of the fixed member 26 for contacting the seal member 28 and opposing the reinforcement member 23 via the seal member 28 and the contact surface 23S of the reinforcement member 23 for contacting the seal member 28 and opposing the fixed member 26 via the seal member 28 have an arc shape protruding upward in FIG. 5B.

As illustrated in FIG. 5A, the seal member 28 sandwiched between the reinforcement member 23 and the fixed member 26 is supported by edges of the through-holes 29B1 of the second stay 29B depicted in FIG. 6C and is stretched downward in FIG. 5A. A center portion of the seal member 28 in a width direction of the seal member 28, that is, in the axial direction of the fixing belt 21 may be stretched downward in FIG. 5A in a range from about 3.0 mm to about 4.0 mm. When no pressure is applied by the pressing roller 31 as illustrated in FIG. 5A, the center portion of the seal member 28 is stretched downward by about 2.0 mm. By contrast, when pressure is applied by the pressing roller 31 as illustrated in FIG. 5B, the center portion of the seal member 28 stretched downward by about 2.0 mm moves upward by about 0.7 mm. As a result, the center portion of the seal member 28 is stretched downward by about 1.3 mm.

As the pressing roller 31 contacts to and separates from the fixing belt 21 depicted in FIG. 4, a position of the contact surface 23S of the reinforcement member 23 for contacting the seal member 28 and opposing the fixed member 26 via the seal member 28 and the contact surface 26S of the fixed member 26 for contacting the seal member 28 and opposing the reinforcement member 23 via the seal member 28 changes. However, the seal member 28 is stretched to absorb the change in the position of the contact surfaces 23S and 26S of the reinforcement member 23 and the fixed member 26, respectively. Consequently, the heating member 22 may not be deformed. An amount of the change (e.g., about 1.0 mm or smaller) in the position of the contact surfaces 23S and 26S of the reinforcement member 23 and the fixed member 26, respectively, is equivalent to an amount of protrusion of the reinforcement member 23 protruding toward the fixed member 26 to have the convex shape.

According to this example embodiment, the contact surface 23S of the reinforcement member 23 for contacting the seal member 28 and opposing the fixed member 26 via the seal member 28 has the convex shape. Alternatively, the contact surface 26S of the fixed member 26 for contacting the seal member 28 and opposing the reinforcement member 23 via the seal member 28 may have a convex shape. For example, when no load is applied to the fixed member 26, that is, when no pressure is applied to the fixed member 26, a center portion of the contact surface 26S of the fixed member 26 in the width direction of the fixed member 26 protrudes toward a counterpart member, that is, the reinforcement member 23 than both end portions of the contact surface 26S of the fixed member 26 in the width direction of the fixed member 26

Yet alternatively, both the contact surface 26S of the fixed member 26 for contacting the seal member 28 and opposing the reinforcement member 23 via the seal member 28 and the contact surface 23S of the reinforcement member 23 for contacting the seal member 28 and opposing the fixed member 26 via the seal member 28 may have the convex shape.

The first convex portion 23*a*, the second convex portions 23*b*, and the third convex portions 23*c* of the reinforcement member 23 depicted in FIG. 5A may have a round point so that the points of the first convex portion 23*a*, the second convex portions 23*b*, and the third convex portions 23*c* may hardly damage the seal member 28 when the reinforcement member 23 presses the seal member 28.

In order to improve heating efficiency for heating the heating member 22, an opposing surface of the reinforcement member 23 opposing the heater 25 may be mirror-finished.

An adjustment mechanism for adjusting positions of the first convex portion 23*a*, the second convex portions 23*b*, and the third convex portions 23*c* of the reinforcement member 23 upward and downward in FIG. 5A may be provided to adjust variation of the nip length in a width direction of the nip portion N parallel to the width direction of the reinforcement member 23.

As illustrated in FIG. 6A, the five through-holes 29A1 are provided in the first stay 29A to correspond to the five convex portions, which are the first convex portion 23*a*, the second convex portions 23*b*, and the third convex portions 23*c*, of the reinforcement member 23 depicted in FIG. 5A, respectively. Similarly, as illustrated in FIG. 6C, the five through-holes 29B1 are provided in the second stay 29B to correspond to the first convex portion 23*a*, the second convex portions 23*b*, and the third convex portions 23*c* of the reinforcement member 23 depicted in FIG. 5A, respectively.

Figure 7:
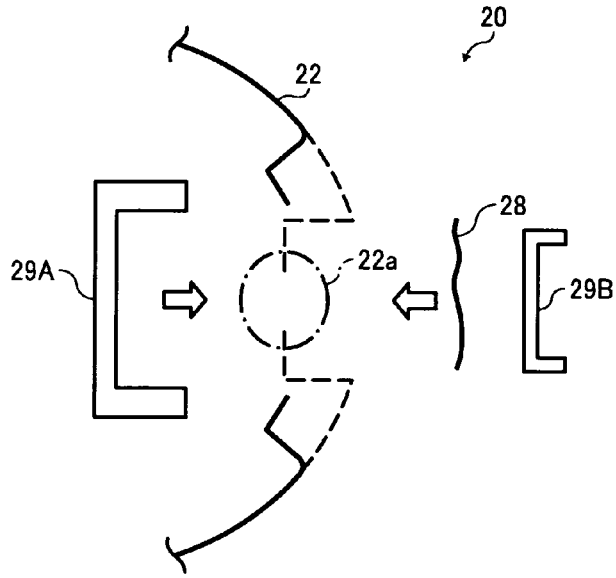
FIG. 7 is a schematic view (according to an example embodiment) of the first stay shown in FIG. 6A, the seal member shown in FIG. 6B, and the second stay shown in FIG. 6C to be attached to a heating member included in the fixing device shown in FIG. 4.

FIG. 7 is a schematic view of the first stay 29A, the seal member 28, and the second stay 29B to be attached to the heating member 22. Referring to FIG. 7, the following describes how to attach the first stay 29A, the seal member 28, and the second stay 29B to the heating member 22.

A workable, stainless steel plate having a thickness of about 0.1 mm is bent to form the heating member 22 having a pipe shape. However, the stainless steel plate may not be bent to have a shape shown in a broken line in FIG. 7 because springback of the stainless steel plate formed into the pipe causes the heating member 22 to have a shape shown in a solid line in FIG. 7. The first stay 29A and the second stay 29B hold L-shaped bent portions of the heating member 22, which form the opening 22*a* of the heating member 22, to have the shape shown in the broken line in FIG. 7. Thus, the heating member 22 has the desired shape shown in the broken line in FIG. 7. For example, the first stay 29A is attached to the inner circumferential surface of the heating member 22 to form the concave portion 22*c* (depicted in FIG. 4) of the heating member 22. Then, the seal member 28 is placed in the concave portion 22*c*. Finally, the second stay 29B is press-fitted into the concave portion 22*c*.

The heating member 22 may have a thickness not greater than about 0.2 mm to improve heating efficiency for heating the heating member 22.

The heating member 22 having the substantially pipe shape formed by bending a metal plate such as the stainless steel plate as described above may have a small thickness to shorten a warm-up time period of the fixing device 20. However, the thin heating member 22 may have a small rigidity. Accordingly, when the pressing roller 31 applies pressure to the heating member 22, the heating member 22 cannot resist the pressure applied by the pressing roller 31, and therefore the heating member 22 may be bent or deformed. The deformed heating member 22 may not provide the desired nip length of the nip portion N, deteriorating fixing property. To address this, according to this example embodiment, the pressing roller 31 does not apply pressure to the thin heating member 22. As a result, the thin heating member 22 may not be deformed.

According to this example embodiment, the second stay 29B is press-fitted into the concave portion 22*c* of the heating member 22 so that the second stay 29B and the heating member 22 sandwich the seal member 28. Thus, the seal member 28 covers or seals the opening 22*a* of the heating member 22. However, the seal member 28 may be attached to the heating member 22 in other methods, for example, by using a first stay 29AX, a seal member 28X, and a second stay 29BX instead of the first stay 29A, the seal member 28, and the second stay 29B, as illustrated in FIGS. 8A, 8B, and 8C, respectively.

Figure 8A:
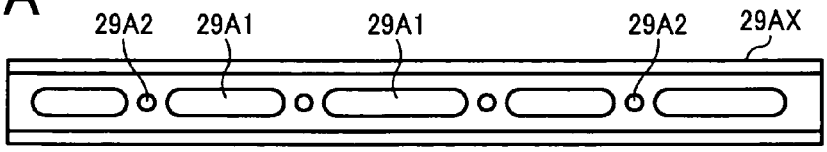
FIG. 8A is a plane view (according to an example embodiment) of another example of a first stay included in the fixing device shown in FIG. 4 seen in a leftward direction in FIG. 4.

FIG. 8A is a plane view of the first stay 29AX. As illustrated in FIG. 8A, the first stay 29AX includes the through-holes 29A1 and/or through-holes 29A2.

Figure 8B:
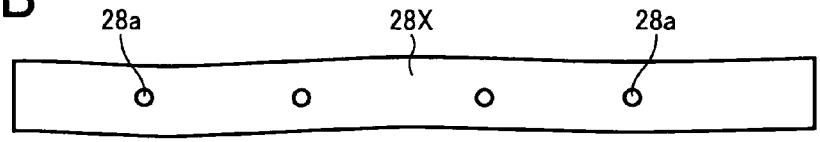
FIG. 8B is a plane view (according to an example embodiment) of another example of a seal member included in the fixing device shown in FIG. 4, seen in a leftward direction in FIG. 4.

FIG. 8B is a plane view of the seal member 28X. As illustrated in FIG. 8B, the seal member 28X includes through-holes 28*a*.

Figure 8C:
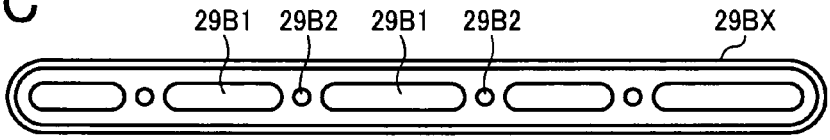
FIG. 8C is a plane view (according to an example embodiment) of another example of a second stay included in the fixing device shown in FIG. 4 seen in a leftward direction in FIG. 4.

FIG. 8C is a plane view of the second stay 29BX. As illustrated in FIG. 8C, the second stay 29BX includes the through-holes 29B1 and/or through-holes 29B2.

As illustrated in FIG. 8A, a plurality of through-holes 29A2 is provided in the first stay 29AX. As illustrated in FIG. 8B, a plurality of through-holes 28*a* is provided in the seal member 28X. As illustrated in FIG. 8C, a plurality of through-holes 29B2 is provided in the second stay 29BX. Female threads are provided in the concave portion 22*c* of the heating member 22 depicted in FIG. 4 to correspond to the through-holes 29A2 of the first stay 29AX, the through-holes 28*a* of the seal member 28X, and the through-holes 29B2 of the second stay 29BX, respectively. Screws are inserted into the through-holes 29B2 of the second stay 29BX, the through-holes 28*a* of the seal member 28X, the female threads of the concave portion 22*c* of the heating member 22, and the through-holes 29A2 of the first stay 29AX in this order so as to screw the screws into the female threads of the concave portion 22*c* of the heating member 22, respectively. Thus, the seal member 28 is attached to the heating member 22.

As illustrated in FIGS. 6A and 6C, according to this example embodiment, the plurality of through-holes 29A1 and the plurality of through-holes 29B1 are provided in the first stay 29A and the second stay 29B to correspond to the plurality of convex portions of the reinforcement member 23, which are the first convex portion 23*a*, the second convex portions 23*b*, and the third convex portions 23*c* depicted in FIG. 5A, respectively.

Figure 9A:
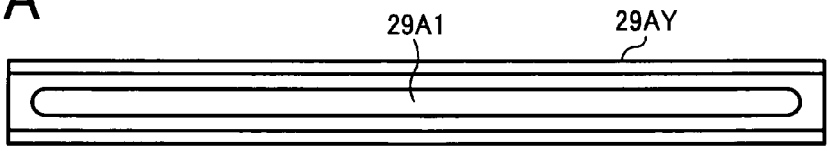
FIG. 9A is a plane view (according to an example embodiment) of yet another example of a first stay included in the fixing device shown in FIG. 4 seen in a leftward direction in FIG. 4.
Figure 9B:
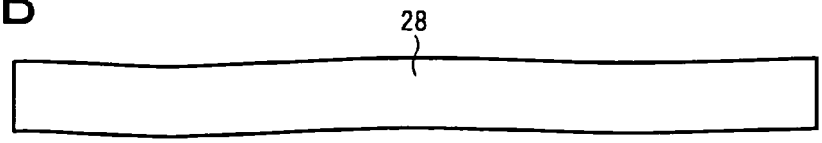
FIG. 9B is a plane view (according to an example embodiment) of yet another example of a seal member included in the fixing device shown in FIG. 4 seen in a leftward direction in FIG. 4.
Figure 9C:
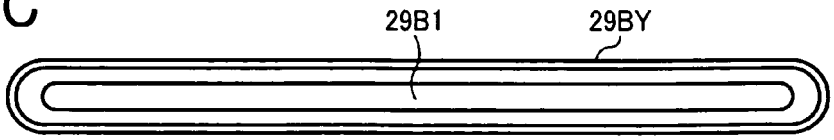
FIG. 9C is a plane view (according to an example embodiment) of yet another example of a second stay included in the fixing device shown in FIG. 4 seen in a leftward direction in FIG. 4.

Alternatively, a single through-hole may be provided in each of a first stay 29AY and a second stay 29BY as illustrated in FIGS. 9A and 9C, respectively. FIG. 9A is a plane view of the first stay 29AY. FIG. 9B is a plane view of the seal member 28. FIG. 9C is a plane view of the second stay 29BY.

As illustrated in FIG. 9A, the single through-hole 29A1 is provided in the first stay 29AY. As illustrated in FIG. 9C, the single through-hole 29B1 is provided in the second stay 29BY. In this case, the contact surface 23S of the reinforcement member 23 for contacting the seal member 28 and opposing the fixed member 26 via the seal member 28 depicted in FIG. 5A is not divided into the plurality of convex portions, but has a single convex portion having an arc shape to correspond to the single through-hole 29A1 of the first stay 29AY and the single through-hole 29B1 of the second stay 29BY.

As illustrated in FIG. 7, according to this example embodiment, the opening 22*a* of the heating member 22 is formed by bending the metal plate and not welding adjacent edges of the metal plate. Accordingly, the opening 22*a* of the heating member 22 is provided across a whole width direction of the heating member 22 (e.g., the axial direction of the fixing belt 21).

Figure 10:
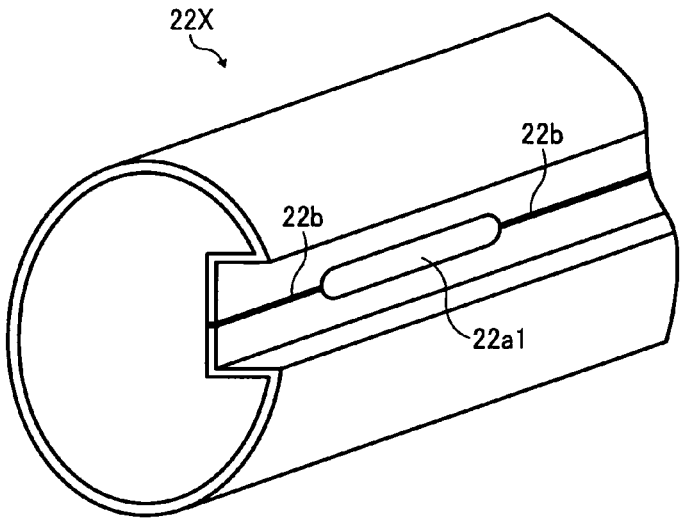
FIG. 10 is a perspective view (according to an example embodiment) of an example of a heating member included in the fixing device shown in FIG. 4.

Alternatively, the adjacent edges of the metal plate may be welded as illustrated in FIG. 10. FIG. 10 is a perspective view of a heating member 22X. As illustrated in FIG. 10, the heating member 22X includes an opening 22*a*1 and/or edges 22*b*.

The opening 22*a*1 of the heating member 22X is formed by bending the metal plate and welding the adjacent edges 22*b* of the metal plate. In this case, a plurality of openings 22*a*1 is provided in a width direction (e.g., an axial direction) of the heating member 22X to correspond to the plurality of through-holes 29A1 of the first stay 29A depicted in FIG. 6A or the first stay 29AX depicted in FIG. 8A, the plurality of through-holes 29B1 of the second stay 29B depicted in FIG. 6C or the second stay 29BX depicted in FIG. 8C, and the plurality of convex portions of the reinforcement member 23 which are the first convex portion 23*a*, the second convex portions 23*b*, and the third convex portions 23*c* depicted in FIG. 5A, respectively.

Like the heating member 22, the heating member 22X may be a pipe member having a thickness not greater than about 0.2 mm.

As described above, in the fixing device 20 depicted in FIG. 4 according to this example embodiment, the fixing belt 21 serving as a flexible endless belt moves in a predetermined direction to heat and melt a toner image T on a transfer sheet P serving as a recording medium. The pressing roller 31 serving as a pressing rotary member opposes the fixing belt 21. The fixed member 26 serving as a fixed member is fixedly provided inside a loop formed by the fixing belt 21 and faces the inner circumferential surface 21*a* of the fixing belt 21. The fixed member 26 is pressed against the pressing roller 31 via the fixing belt 21 to form the nip portion N between the pressing roller 31 and the fixing belt 21 to nip the transfer sheet P bearing the toner image T as the transfer sheet P bearing the toner image T passes therethrough. The heating member 22 or 22X (depicted in FIG. 10) serving as a heating member is fixedly provided inside the loop formed by the fixing belt 21 and faces the inner circumferential surface 21*a* of the fixing belt 21 to heat the fixing belt 21. The heating member 22 or 22X includes the opening 22*a* or 22*a*1 (depicted in FIG. 10) serving as an opening opposing the pressing roller 31. The seal member 28 (e.g., a sheet member) serving as a seal member covers or seals the opening 22*a* or 22*a*1 in the heating member 22 or 22X to prevent a foreign substance (e.g., a lubricant) from entering the heating member 22 or 22X through the opening 22*a* or 22*a*1 in the heating member 22 or 22X. The reinforcement member 23 serving as a reinforcement member is fixedly provided inside the heating member 22 or 22X in such a manner that the reinforcement member 23 opposes the inner circumferential surface of the heating member 22 or 22X. The reinforcement member 23 is pressed against the fixed member 26 via the seal member 28 to reinforce the fixed member 26.

Thus, even when the warm-up time period and the first print time period are short and the image forming apparatus 1 depicted in FIG. 1 forms a toner image T on a transfer sheet P at a high speed, the fixing device 20 can fix the toner image T on the transfer sheet P properly while preventing a foreign substance such as the lubricant from entering the heating member 22 or 22X. Further, even when the pressing roller 31 applies an increased pressure to the thin heating member 22 or 22X, or the pressing roller 31 contacts to and separates from the fixing belt 21, the heating member 22 may or 22X not be deformed.

Figure 11:
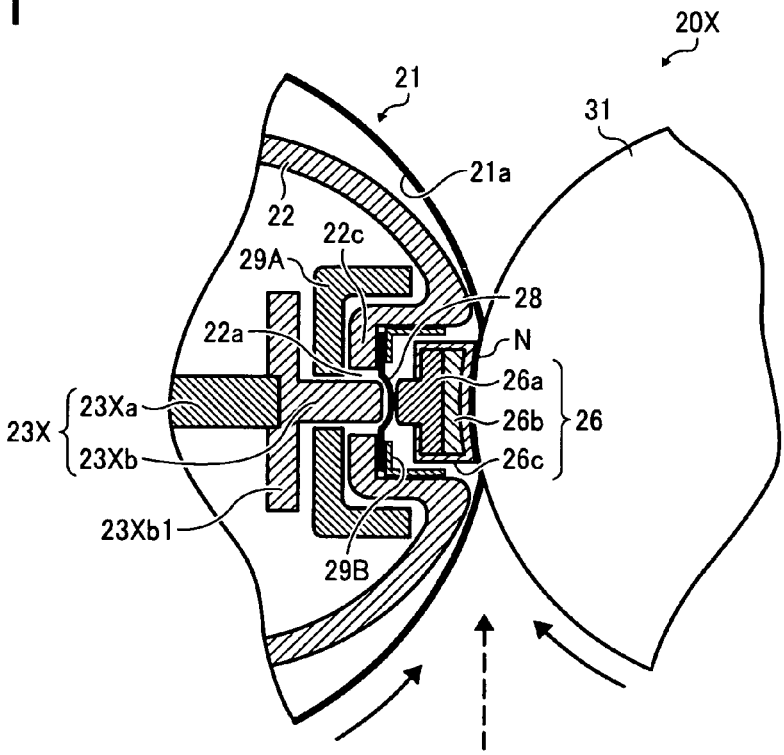
FIG. 11 is a partially enlarged view of a fixing device according to another example embodiment.

Referring to FIG. 11, the following describes a fixing device 20X according to another example embodiment. FIG. 11 is a partially enlarged view of the fixing device 20X. As illustrated in FIG. 11, the fixing device 20X includes a reinforcement member 23X. The reinforcement member 23X includes a main portion 23Xa and/or a head portion 23Xb. The head portion 23Xb includes a shield portion 23Xb1.

In the fixing device 20X, the reinforcement member 23X replaces the reinforcement member 23 of the fixing device 20 depicted in FIG. 4. The other elements of the fixing device 20X are equivalent to the elements of the fixing device 20 depicted in FIG. 4. In other words, the fixing device 20X includes the fixing belt 21 serving as a belt, the fixed member 26, the heating member 22, the reinforcement member 23X, the heater 25 depicted in FIG. 2, the first stay 29A, the second stay 29B serving as a retainer, the seal member 28, the pressing roller 31 serving as a pressing rotary member, the temperature sensor 40 depicted in FIG. 2, and the contact-separate mechanism 54 depicted in FIG. 2.

In the fixing device 20X depicted in FIG. 11 illustrating the elements provided near the nip portion N, at least a portion (e.g., a contact surface) of the reinforcement member 23X that contacts the seal member 28 (e.g., a sheet member) includes a material having a low heat conductivity.

For example, in the reinforcement member 23X, the main portion 23Xa includes stainless steel. The head portion 23Xb includes a material having a heat conductivity lower than a heat conductivity of the main portion 23Xa, such as ceramic. Accordingly, even when the heater 25 (depicted in FIG. 2) provided inside the heating member 22 heats the reinforcement member 23X, heat is not easily transmitted from the reinforcement member 23X to the seal member 28 via the head portion 23Xb. Consequently, the seal member 28 may not degrade due to heat.

An opposing surface of the main portion 23Xa of the reinforcement member 23X for opposing the heater 25 is mirror-finished. Accordingly, the main portion 23Xa of the reinforcement member 23X easily reflects radiation light emitted by the heater 25 and therefore is not heated easily, improving heating efficiency for heating the heating member 22.

Like the reinforcement member 23 depicted in FIG. 5A, the contact surface 23S of the head portion 23Xb of the reinforcement member 23X for contacting the seal member 28 and opposing the fixed member 26 via the seal member 28 is divided into five convex portions to correspond to the through-holes 29A1 of the first stay 29A or 29AX depicted in FIG. 6A or 8A and the through-holes 29B1 of the second stay 29B or 29BX depicted in FIG. 6C or 8C.

The shield portion 23Xb1 is provided near the opening 22*a* of the heating member 22 to serve as a shield member for shielding the seal member 28 from radiation light emitted by the heater 25. Thus, the shield portion 23Xb1 prevents the radiation light emitted by the heater 25 from reaching the seal member 28.

For example, as illustrated in FIG. 11, the head portion 23Xb of the reinforcement member 23X is T-shaped to cover the opening 22*a* of the heating member 22 from inside of the heating member 22. Accordingly, the shield portion 23Xb1 of the head portion 23Xb of the reinforcement member 23X prevents radiation light emitted by the heater 25 from entering the opening 22*a* of the heating member 22 and heating the seal member 28. Consequently, the seal member 28 may not degrade due to heat.

A predetermined clearance is provided between the head portion 23Xb of the reinforcement member 23X and the first stay 29A so that the head portion 23Xb of the reinforcement member 23X does not contact the first stay 29A.

As described above, in the fixing device 20X according to this example embodiment, like in the fixing device 20 depicted in FIG. 4, the fixing belt 21 serving as a flexible endless belt moves in a predetermined direction to heat and melt a toner image T on a transfer sheet P serving as a recording medium. The pressing roller 31 serving as a pressing rotary member opposes the fixing belt 21. The fixed member 26 serving as a fixed member is fixedly provided inside a loop formed by the fixing belt 21 and faces the inner circumferential surface 21*a* of the fixing belt 21. The fixed member 26 is pressed against the pressing roller 31 via the fixing belt 21 to form the nip portion N between the pressing roller 31 and the fixing belt 21 to nip the transfer sheet P bearing the toner image T as the transfer sheet P bearing the toner image T passes therethrough. The heating member 22 serving as a heating member is fixedly provided inside the loop formed by the fixing belt 21 and faces the inner circumferential surface 21*a* of the fixing belt 21 to heat the fixing belt 21. The heating member 22 includes the opening 22*a* serving as an opening opposing the pressing roller 31. The seal member 28 (e.g., a sheet member) serving as a seal member covers or seals the opening 22*a* in the heating member 22 to prevent a foreign substance (e.g., a lubricant) from entering the heating member 22 through the opening 22*a* in the heating member 22. The reinforcement member 23X serving as a reinforcement member is fixedly provided inside the heating member 22 in such a manner that the reinforcement member 23X opposes the inner circumferential surface of the heating member 22. The reinforcement member 23X is pressed against the fixed member 26 via the seal member 28 to reinforce the fixed member 26.

Thus, even when the warm-up time period and the first print time period are short and the image forming apparatus 1 depicted in FIG. 1 forms a toner image T on a transfer sheet P at a high speed, the fixing device 20X can fix the toner image T on the transfer sheet P properly while preventing a foreign substance such as the lubricant from entering the heating member 22. Further, even when the pressing roller 31 applies an increased pressure to the thin heating member 22, or the pressing roller 31 contacts to and separates from the fixing belt 21, the heating member 22 may not be deformed.

Figure 12:
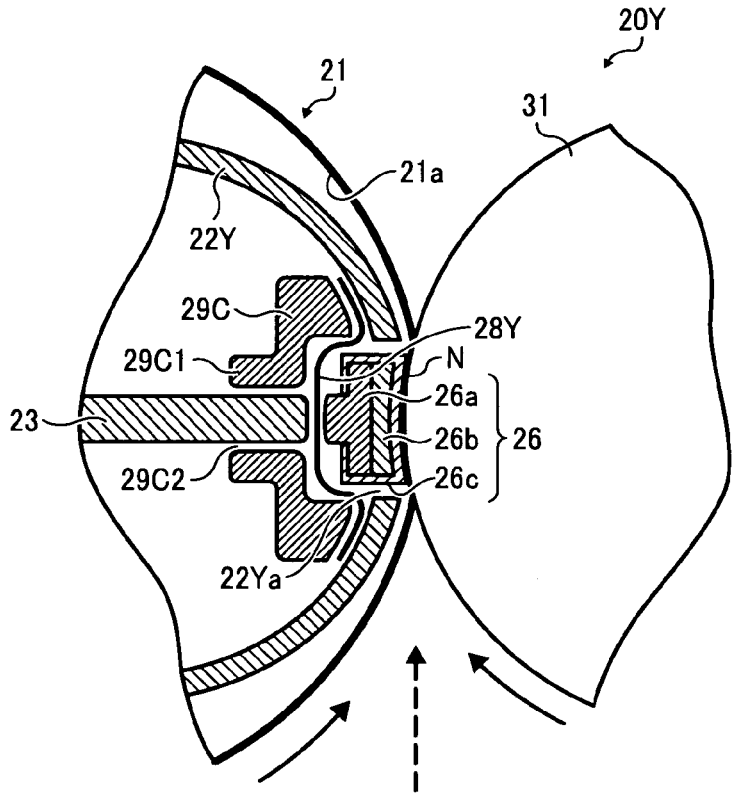
FIG. 12 is a partially enlarged view of a fixing device according to yet another example embodiment.
Figure 13:
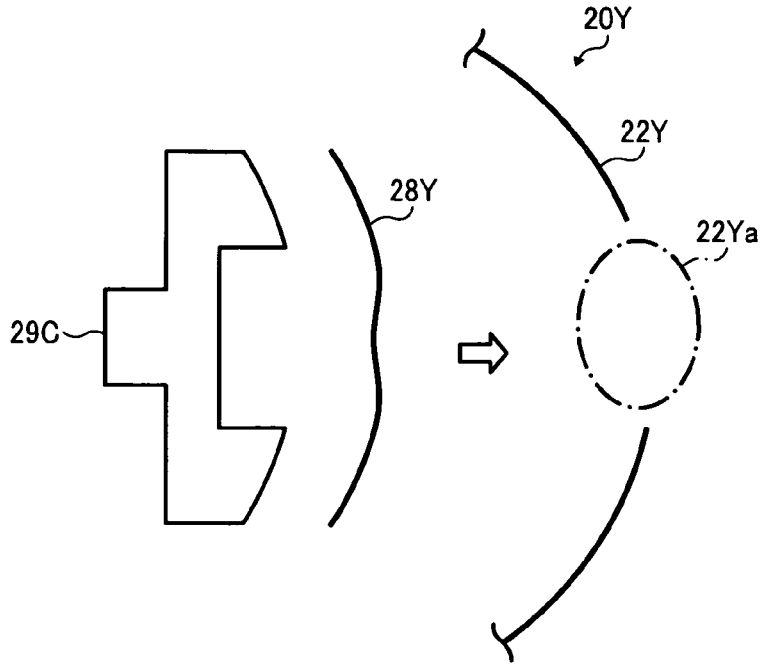
FIG. 13 is a schematic view (according to an example embodiment) of a stay and a seal member to be attached to a heating member included in the fixing device shown in FIG. 12.

Referring to FIGS. 12 and 13, the following describes a fixing device 20Y according to yet another example embodiment. FIG. 12 is a partially enlarged view of the fixing device 20Y.

As illustrated in FIG. 12, the fixing device 20Y includes a heating member 22Y, a seal member 28Y, and/or a stay 29C. The heating member 22Y includes an opening 22Ya. The stay 29C includes a shield portion 29C1 and/or a through-hole 29C2.

FIG. 13 is a schematic view of the stay 29C and the seal member 28Y to be attached to the heating member 22Y.

In the fixing device 20Y, the heating member 22Y replaces the heating member 22 of the fixing device 20 depicted in FIG. 4. The seal member 28Y replaces the seal member 28 of the fixing device 20. The stay 29C replaces the first stay 29A and the second stay 29B of the fixing device 20. The other elements of the fixing device 20Y are equivalent to the elements of the fixing device 20. In other words, the fixing device 20Y includes the fixing belt 21 serving as a belt, the fixed member 26, the heating member 22Y, the reinforcement member 23, the heater 25 depicted in FIG. 2, the stay 29C serving as a retainer, the seal member 28Y, the pressing roller 31 serving as a pressing rotary member, the temperature sensor 40 depicted in FIG. 2, and the contact-separate mechanism 54 depicted in FIG. 2.

In the fixing device 20Y depicted in FIG. 12 illustrating the elements provided near the nip portion N, the heating member 22Y includes a C-shaped pipe member, unlike the heating member 22 of the fixing device 20 (depicted in FIG. 4) which has the concave portion 22*c*. Like the heating member 22, the heating member 22Y may have a thickness not greater than about 0.2 mm. Like in the fixing device 20, the opening 22Ya of the heating member 22Y opposes the pressing roller 31 serving as a pressing rotary member. The seal member 28Y (e.g., a sheet member) covers or seals the opening 22Ya of the heating member 22Y. The seal member 28Y may be a deformable thin film member or a deformable thin sheet member including at least one of silicon rubber, fluorocarbon rubber, and fluorocarbon resin and having a thickness in a range from about 0.1 mm to about 0.5 mm. The fixed member 26 is pressed against the reinforcement member 23 via the seal member 28Y. The opening 22Ya of the heating member 22Y has a size large enough for the heating member 22Y not to receive pressure applied by the pressing roller 31.

The stay 29C, serving as a retainer, is positioned at edges (e.g., a circumference) of the opening 22Ya in the heating member 22Y in such a manner that the stay 29C and the heating member 22Y sandwich the seal member 28Y. Like the first stay 29A depicted in FIG. 6A and the first stay 29AX depicted in FIG. 8A, a plurality of through-holes is provided in the stay 29C in a width direction of the stay 29C, that is, in the axial direction of the fixing belt 21. The contact surface 23S of the reinforcement member 23 for contacting the seal member 28Y and opposing the fixed member 26 via the seal member 28Y is divided into a plurality of convex portions corresponding to the plurality of through-holes of the stay 29C, as illustrated in FIG. 5A.

Referring to FIG. 13, the following describes how to attach the stay 29C and the seal member 28Y to the heating member 22Y.

For example, the heating member 22Y is bent into a C-shape to form the opening 22Ya. The stay 29C is attached to the seal member 28Y from an inner side of the seal member 28Y so that the stay 29C and the heating member 22Y sandwich the seal member 28Y.

According to this example embodiment, the stay 29C, serving as a retainer, includes stainless steel and the reinforcement member 23 includes ceramic.

As illustrated in FIG. 12, the shield portion 29C1 is provided in the stay 29C serving as a retainer. The shield portion 29C1 serves as a shield member for shielding the seal member 28Y (e.g., a sheet member) from radiation light emitted by the heater 25 depicted in FIG. 2. Thus, the shield portion 29C1 prevents the radiation light emitted by the heater 25 from reaching the seal member 28Y. The reinforcement member 23 penetrates the through-hole 29C2 of the stay 29C. The through-hole 29C2 has a relatively long length (e.g., depth). Accordingly, the shield portion 29C1 prevents or reduces radiation light emitted by the heater 25 reaching the seal member 28Y, suppressing degradation of the seal member 28Y due to heat.

As described above, in the fixing device 20Y according to this example embodiment, like in the fixing device 20 depicted in FIG. 4 and the fixing device 20X depicted in FIG. 11, the fixing belt 21 serving as a flexible endless belt moves in a predetermined direction to heat and melt a toner image T on a transfer sheet P serving as a recording medium. The pressing roller 31 serving as a pressing rotary member opposes the fixing belt 21. The fixed member 26 serving as a fixed member is fixedly provided inside a loop formed by the fixing belt 21 and faces the inner circumferential surface 21*a* of the fixing belt 21. The fixed member 26 is pressed against the pressing roller 31 via the fixing belt 21 to form the nip portion N between the pressing roller 31 and the fixing belt 21 to nip the transfer sheet P bearing the toner image T as the transfer sheet P bearing the toner image T passes therethrough. The heating member 22Y serving as a heating member is fixedly provided inside the loop formed by the fixing belt 21 and faces the inner circumferential surface 21*a* of the fixing belt 21 to heat the fixing belt 21. The heating member 22Y includes the opening 22Ya serving as an opening opposing the pressing roller 31. The seal member 28Y (e.g., a sheet member) serving as a seal member covers or seals the opening 22Ya in the heating member 22Y to prevent a foreign substance (e.g., a lubricant) from entering the heating member 22Y through the opening 22Ya in the heating member 22Y. The reinforcement member 23 serving as a reinforcement member is fixedly provided inside the heating member 22Y in such a manner that the reinforcement member 23 opposes an inner circumferential surface of the heating member 22Y. The reinforcement member 23 is pressed against the fixed member 26 via the seal member 28Y to reinforce the fixed member 26.

Thus, even when the warm-up time period and the first print time period are short and the image forming apparatus 1 depicted in FIG. 1 forms a toner image T on a transfer sheet P at a high speed, the fixing device 20Y can fix the toner image T on the transfer sheet P properly while preventing a foreign substance such as the lubricant from entering the heating member 22Y. Further, even when the pressing roller 31 applies an increased pressure to the thin heating member 22Y, or the pressing roller 31 contacts to and separates from the fixing belt 21, the heating member 22Y may not be deformed.

As described above, an image forming apparatus (e.g., the image forming apparatus 1 depicted in FIG. 1) includes a fixing device (e.g., the fixing device 20 depicted in FIG. 4, the fixing device 20X depicted in FIG. 11, or the fixing device 20Y depicted in FIG. 12). In the fixing device, a pressing rotary member (e.g., the pressing roller 31 depicted in FIG. 4, 11, or 12) is pressed against a fixed member (e.g., the fixed member 26 depicted in FIG. 4, 11, or 12) via a belt (e.g., the fixing belt 21 depicted in FIG. 4, 11, or 12) to form a nip portion (e.g., the nip portion N depicted in FIG. 4, 11, or 12) between the pressing rotary member and the belt. An opening (e.g., the opening 22*a* depicted in FIG. 4 or 11, the opening 22*a*1 depicted in FIG. 10, or the opening 22Ya depicted in FIG. 12) of a heating member (e.g., the heating member 22 depicted in FIG. 4 or 11, the heating member 22X depicted in FIG. 10, or the heating member 22Y depicted in FIG. 12) opposes the pressing rotary member. A seal member (e.g., the seal member 28 depicted in FIG. 4 or 11 or the seal member 28Y depicted in FIG. 12) covers or seals the opening in the heating member. The fixed member is pressed against a reinforcement member (e.g., the reinforcement member 23 depicted in FIG. 4 or 12 or the reinforcement member 23X depicted in FIG. 11) via the seal member. The reinforcement member is fixedly provided inside the heating member in such a manner that the reinforcement member opposes an inner circumferential surface of the heating member. In other words, the reinforcement member is pressed against the fixed member via the seal member to reinforce the fixed member.

Thus, even when the warm-up time period and the first print time period are short and the image forming apparatus forms a toner image on a transfer sheet at a high speed, the fixing device can fix the toner image on the transfer sheet properly while preventing a foreign substance such as a lubricant from entering the heating member. Further, even when the pressing rotary member applies an increased pressure to the thin heating member, or the pressing rotary member contacts to and separates from the belt, the heating member may not be deformed.

According to the above-described example embodiments, the fixing device includes the pressing roller serving as a pressing rotary member. Alternatively, the fixing device may include a pressing belt serving as a pressing rotary member to provide the above-described effects.

According to the above-described example embodiments, the fixing device includes the fixing belt having a plurality of layers, which serves as a belt. Alternatively, the fixing device may include an endless fixing film including polyimide, polyamide, fluorocarbon resin, and/or metal, which serves as a belt to provide the above-described effects.

According to the above-described example embodiments, the fixing device includes a heater (e.g., the heater 25 depicted in FIG. 2) provided inside the heating member so as to heat the heating member in a heater method. Alternatively, the fixing device may include an exciting coil serving as a heater for heating the heating member in an induction heating method. In this case, the exciting coil may be provided inside the heating member. Yet alternatively, the fixing device may include a resistance heating element serving as a heater for heating the heating member. In this case, the resistance heating element may be provided inside the heating member. Also in the fixing device including the exciting coil or the resistance heating element serving as a heater, a foreign substance may not be adhered to the heater provided inside the heating member and the heating member may not be deformed to provide the above-described effects.

In the above-described example embodiments, when the fixed member, the heating member, and the reinforcement member are "fixedly provided", the fixed member, the heating member, and the reinforcement member are held or supported without being rotated. Therefore, even when a force applier such as a spring presses the fixed member against the nip portion, for example, the fixed member is "fixedly provided" as long as the fixed member is held or supported without being rotated.

In the above-described example embodiments, a "foreign substance" entering the heating member includes any substance which should not enter the heating member. Therefore, for example, a lubricant applied between the heating member and the belt to decrease resistance generated between the heating member and the belt sliding over the heating member may be the "foreign substance" when the lubricant enters the heating member.

The present invention has been described above with reference to specific example embodiments. Nonetheless, the present invention is not limited to the details of example embodiments described above, but various modifications and improvements are possible without departing from the spirit and scope of the present invention. It is therefore to be understood that within the scope of the associated claims, the present invention may be practiced otherwise than as specifically described herein. For example, elements and/or features of different illustrative example embodiments may be combined with each other and/or substituted for each other within the scope of the present invention.

What is claimed is:

1. A fixing device comprising:

a flexible endless belt to move in a predetermined direction to heat and melt a toner image on a recording medium;

a pressing rotary member opposing the belt;

a fixed member fixedly provided inside a loop formed by the belt and facing an inner circumferential surface of the belt, the fixed member being pressed against the pressing rotary member via the belt to form a nip portion between the pressing rotary member and the belt to nip the recording medium bearing the toner image as the recording medium bearing the toner image passes therethrough;

a heating member fixedly provided inside the loop formed by the belt and facing the inner circumferential surface of the belt to heat the belt, the heating member comprising an opening opposing the pressing rotary member;

a seal member to cover the opening in the heating member to prevent a foreign substance from entering the heating member through the opening in the heating member; and a reinforcement member fixedly provided inside the heating member and pressed against the fixed member via the seal member to reinforce the fixed member.

2. The fixing device according to claim 1, further comprising a retainer positioned at a circumference of the opening in the heating member, the retainer and the heating member sandwiching the seal member therebetween.

3. The fixing device according to claim 1, further comprising a heater provided inside the heating member to heat the heating member, wherein the heating member further comprises a concave portion encompassing the opening, into which the fixed member is inserted, and wherein the seal member is provided on an outer circumferential surface of the concave portion of the heating member opposite an inner circumferential surface of the concave portion of the heating member opposing the heater.

4. The fixing device according to claim 1, further comprising:

a heater provided inside the heating member to emit radiation light to heat the heating member; and a shield member to shield the seal member from the radiation light emitted by the heater.

5. The fixing device according to claim 1, wherein at least one of the reinforcement member and the fixed member opposing each other via the seal member comprises a contact surface for contacting the seal member, and wherein, in a state in which no load is applied to the reinforcement member and the fixed member, a center portion of the contact surface of the at least one of the reinforcement member and the fixed member in a width direction of the reinforcement member and the fixed member protrudes toward the seal member farther than both end portions of the contact surface of the at least one of the reinforcement member and the fixed member in the width direction of the reinforcement member and the fixed member.

6. The fixing device according to claim 1, wherein at least a portion of the reinforcement member that contacts the seal member comprises a material having a low heat conductivity.

7. The fixing device according to claim 1, wherein the seal member comprises a deformable sheet member including at least one of silicon rubber, fluorocarbon rubber, and fluorocarbon resin.

8. The fixing device according to claim 1, wherein the heating member comprises a pipe member having a thickness not greater than about 0.2 mm.

9. The fixing device according to claim 1, wherein the foreign substance includes a lubricant applied between the belt and the heating member.

10. An image forming apparatus comprising:

a fixing device to fix a toner image on a recording medium, comprising:

a flexible endless belt to move in a predetermined direction to heat and melt the toner image on the recording medium;

a pressing rotary member opposing the belt;

a fixed member fixedly provided inside a loop formed by the belt and facing an inner circumferential surface of the belt, the fixed member being pressed against the pressing rotary member via the belt to form a nip portion between the pressing rotary member and the belt to nip the recording medium bearing the toner image as the recording medium bearing the toner image passes therethrough;

a heating member fixedly provided inside the loop formed by the belt and facing the inner circumferential surface of the belt to heat the belt, the heating member comprising an opening opposing the pressing rotary member;

a seal member to cover the opening in the heating member to prevent a foreign substance from entering the heating member through the opening in the heating member; and a reinforcement member fixedly provided inside the heating member and pressed against the fixed member via the seal member to reinforce the fixed member.

11. The image forming apparatus according to claim 10, wherein the fixing device further comprises a retainer positioned at a circumference of the opening in the heating member, the retainer and the heating member sandwiching the seal member therebetween.

12. The image forming apparatus according to claim 10, wherein the fixing device further comprises a heater provided inside the heating member to heat the heating member, wherein the heating member further comprises a concave portion encompassing the opening, into which the fixed member is inserted, and wherein the seal member is provided on an outer circumferential surface of the concave portion of the heating member opposite an inner circumferential surface of the concave portion of the heating member opposing the heater.

13. The image forming apparatus according to claim 10, wherein the fixing device further comprises:

a heater provided inside the heating member to emit radiation light to heat the heating member; and a shield member to shield the seal member from the radiation light emitted by the heater.

14. The image forming apparatus according to claim 10, wherein at least one of the reinforcement member and the fixed member opposing each other via the seal member comprises a contact surface for contacting the seal member, and wherein, in a state in which no load is applied to the reinforcement member and the fixed member, a center portion of the contact surface of the at least one of the reinforcement member and the fixed member in a width direction of the reinforcement member and the fixed member protrudes toward the seal member farther than both end portions of the contact surface of the at least one of the reinforcement member and the fixed member in the width direction of the reinforcement member and the fixed member.

15. The image forming apparatus according to claim 10, wherein at least a portion of the reinforcement member that contacts the seal member comprises a material having a low heat conductivity.

16. The image forming apparatus according to claim 10, wherein the seal member comprises a deformable sheet member including at least one of silicon rubber, fluorocarbon rubber, and fluorocarbon resin.

17. The image forming apparatus according to claim 10, wherein the heating member comprises a pipe member having a thickness not greater than about 0.2 mm.

18. The image forming apparatus according to claim 10, wherein the foreign substance includes a lubricant applied between the belt and the heating member.

* * * * *